US011143212B2

(12) United States Patent
Shirouzu et al.

(10) Patent No.: US 11,143,212 B2
(45) Date of Patent: Oct. 12, 2021

(54) CONTROL DEVICE FOR HYDRAULIC MACHINE

(71) Applicant: Yanmar Co., Ltd., Osaka (JP)

(72) Inventors: Takayuki Shirouzu, Chikugo (JP); Masahiro Itani, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 179 days.

(21) Appl. No.: 16/605,169

(22) PCT Filed: Apr. 18, 2018

(86) PCT No.: PCT/JP2018/016056
§ 371 (c)(1),
(2) Date: Oct. 14, 2019

(87) PCT Pub. No.: WO2018/194110
PCT Pub. Date: Oct. 25, 2018

(65) Prior Publication Data

US 2021/0180294 A1 Jun. 17, 2021

(30) Foreign Application Priority Data

Apr. 19, 2017 (JP) ..... JP2017-082966

(51) Int. Cl.
*F15B 11/16* (2006.01)
*E02F 9/22* (2006.01)
(Continued)

(52) U.S. Cl.
CPC ..... *F15B 11/165* (2013.01); *E02F 9/2235* (2013.01); *E02F 9/2246* (2013.01);
(Continued)

(58) Field of Classification Search
CPC ..... F15B 11/165; F15B 2211/253
See application file for complete search history.

(56) References Cited

U.S. PATENT DOCUMENTS 5,129,230 A * 7/1992 Izumi ..... E02F 9/2225 60/452
5,285,642 A * 2/1994 Watanabe ..... F15B 11/165 60/452

(Continued)

FOREIGN PATENT DOCUMENTS

JP H2-076904 A 3/1990
JP 2526440 Y2 2/1997

(Continued)

OTHER PUBLICATIONS

International Search Report dated Jul. 24, 2018 issued in corresponding PCT Application PCT/JP2018/016056.

*Primary Examiner* — Michael Leslie
(74) *Attorney, Agent, or Firm* — Norton Rose Fulbright US LLP

(57) ABSTRACT

A control device for a hydraulic machine such as a revolving excavator work machine in which a load-sensing pump control system is adopted The control device prevents variation in pump control characteristics among a plurality of hydraulic machines and also prevents variation in the operating speed of individual drive units in the hydraulic machines The control device; and it is configured to perform, by using a storage unit and a calculation unit outside the hydraulic machine, a process of causing an engine rotation state and a hydraulic actuator operation state to be specific states and calculating a correction rate for a control output value of an electromagnetic proportional valve for generating a control pressure, based on detection of an error in the flow rate of a hydraulic pump or its substitute numerical value such as the rotational speed and the like of a traveling motor which is easily detectable from outside.

5 Claims, 9 Drawing Sheets

(51) Int. Cl.
*F15B 15/20* (2006.01)
*E02F 3/32* (2006.01)

(52) U.S. Cl.
CPC ..... *E02F 9/2271* (2013.01); *E02F 9/2296* (2013.01); *F15B 15/20* (2013.01); *E02F 3/325* (2013.01); *E02F 9/2285* (2013.01); *E02F 9/2292* (2013.01); *F15B 2211/253* (2013.01); *F15B 2211/6303* (2013.01)

(56) References Cited

U.S. PATENT DOCUMENTS

| | | | | |
|---|---|---|---|---|
| 6,422,009 | B1 * | 7/2002 | Nozawa | F04B 49/002 60/447 |
| 6,526,747 | B2 * | 3/2003 | Nakatani | E02F 9/22 60/399 |
| 7,878,770 | B2 * | 2/2011 | Oka | E02F 9/2296 417/278 |
| 9,200,431 | B2 * | 12/2015 | Mori | E02F 9/2296 |
| 9,909,281 | B2 * | 3/2018 | Nakagaki | E02F 3/325 |
| 10,066,610 | B2 * | 9/2018 | Yamada | F15B 11/167 |
| 10,260,531 | B2 * | 4/2019 | Kondo | F15B 11/165 |
| 11,015,322 | B2 * | 5/2021 | Shirouzu | F02D 29/04 |
| 2020/0056350 | A1 * | 2/2020 | Shirouzu | E02F 9/2225 |

FOREIGN PATENT DOCUMENTS

| | | | |
|---|---|---|---|
| JP | 2007-225095 | A | 9/2007 |
| JP | 2011-196116 | A | 10/2011 |
| JP | 2011-247301 | A | 12/2011 |

* cited by examiner (a)

(b)

(c)

CONTROL DEVICE FOR HYDRAULIC MACHINE

CROSS REFERENCES TO RELATED APPLICATIONS

This application is a national stage application pursuant to 35 U.S.C. 371 of International Application No. PCT/JP2018/016056, filed on Apr. 18, 2018 which claims priority under 35 U.S.C. § 119 to Japanese Patent Application No. 2017-082966 filed on Apr. 19, 2017, the disclosures of which are hereby incorporated by reference in their entireties.

TECHNICAL FIELD

The present invention relates to a control device used for a hydraulic oil supply system for supplying hydraulic oil to a hydraulic actuator that drives a hydraulic machine such as a revolving excavator work machine.

BACKGROUND ART

Conventionally known is a hydraulic oil supply system for a hydraulic actuator that drives a hydraulic machine such as a revolving excavator work machine, the hydraulic oil supply system being configured to supply hydraulic oil ejected from a variable displacement type hydraulic pump to the hydraulic actuator via a direction control valve, as shown in Patent Literatures 1, 2, and 3 (PTL 1, PTL 2, PTL 3) for example.

Of the above, a control device disclosed in PTL 1 and PTL 2 for controlling a pump ejection oil flow rate is configured as a load-sensing pump control system to adjust the ejection oil amount ejected from a hydraulic pump such that a difference (hereinafter, simply referred to as "differential pressure") between an ejection pressure of the hydraulic pump and a load pressure at a secondary side of a direction control valve (at an inlet port side of the hydraulic actuator) can be constant, by using a load-sensing valve, and on the other hand, the area of opening of a meter-in throttle that narrows a flow channel in the direction control valve from the hydraulic pump to the hydraulic actuator is changed in accordance with the amount of operation on a manual operation tool of the direction control valve. Accordingly, a necessary amount of hydraulic oil corresponding to an operating speed of the actuator set by the manual operation tool is supplied from the direction control valve to the hydraulic actuator. Thus, an operation efficiency of the hydraulic oil supply system can be increased.

Further, in order to allow an amount of oil ejected from the hydraulic pump to be changed according to a change in the usage (mode), the pump control system disclosed in PTL 1 and PTL 2 is capable of changing the target value of the differential pressure by adding a control pressure to the load-sensing valve.

To generate this control pressure, the load-sensing type pump control system is provided with an electromagnetic proportional valve, and a secondary pressure thereof is added as the control pressure to the load-sensing valve. Further, positioning of the load-sensing valve is settled by balancing of the spring force and the load pressure relative to the ejection pressure and the control pressure.

Further, as a hydraulic oil supply system for a plurality of actuators in an excavator work machine and the like, a system provided with a unified bleed-off valve is known. PTL 3 discloses a technique to correct a proportional valve command value for controlling the unified bleed-off valve based on a detected pump pressure, according to the tolerance of the plurality of hydraulic actuators.

CITATION LIST

Patent Literature

PTL 1: Japanese Patent Application Laid-Open No. 2011-247301

PTL 2: Japanese Patent Application Laid-Open No. H2-76904 (1990)

PTL 3: Japanese Patent Application Laid-Open No. 2007-225095

SUMMARY OF INVENTION

Technical Problem

In a work vehicle having a load-sensing system as described above, the direction control valves each have a meter-in throttle. An opening area of the meter-in throttle is determined in accordance with an operation amount of a manual operation tool. However, the opening area is uneven. This will not only result in a variation related to the operating performance of hydraulic actuators in a single hydraulic machine (revolving excavator work machine and the like), but also cause a variation in the performance of the hydraulic machines.

Further, in the load-sensing type pump control system, an error in the performance of a spring for setting the target differential pressure of the load-sensing valve and an error in the characteristic of the secondary pressure in the electromagnetic proportional valve for generating a control pressure with respect to the current characteristic appear in the form of an error in the performance of controlling the amount of oil ejected from the hydraulic pump. Meanwhile, an error in the ejection performance of the hydraulic pump appears in the form of an error in the operating speed of all of the hydraulic actuators of the work vehicle.

Even if these factors are within their ranges of tolerance, accumulation of these factors will lead to a considerable difference in the operating performance among the hydraulic actuators of the hydraulic machines.

Further, under a condition where the control pressure is increased, the target differential pressure for the load-sensing valve is reduced, and the pump ejection flow rate is reduced. On the other hand, the range of deviation in the target differential pressure relative to the median of the tolerance is broadened, because variation in the characteristic of the electromagnetic proportional valve which generates a control pressure is combined with the variation in the target differential pressure of the pump. As a result, the range of variation in an actual operating speed (ejection flow rate) with respect to the designed operating speed (ejection flow rate) increases with an increase in the control pressure.

For example, in a case where a boom or the like is actuated for a lift-up (crane) work with a revolving excavator work machine, the traveling speed needs to be suppressed extremely low. To this end, a large control pressure is applied to suppress the pump ejection flow rate. Therefore, the range of variation is broadened as compared to an occasion of a high speed operation with a small control pressure.

Meanwhile, to control the unified bleed-off valve disposed in PTL 3, the ejection pressure of the hydraulic pump needs to be monitored to define the correction amount for the proportional valve command value. This, however, requires a pressure sensor to be installed, which consequently leads to an increase in the costs.

Solution to Problem

To solve the problems described above, a control device for a hydraulic machine disclosed herein has the following configuration.

A control device for a hydraulic machine of the present disclosure is a control device for a hydraulic machine including a plurality of hydraulic actuators that are driven by oil ejected from a variable displacement type hydraulic pump driven by an engine. The control device is configured to control a flow rate of the oil ejected from the hydraulic pump to achieve a target value of a differential pressure between an ejection pressure of the oil ejected from the hydraulic pump and a load pressure of oil supplied to the hydraulic actuators. A control pressure for changing the target value of the differential pressure is generated as a secondary pressure of an electromagnetic proportional valve. The control device includes: a first calculation unit and a target engine rotation number detection unit provided in the hydraulic machine; and a storage unit, a second calculation unit, and a measured value detection unit provided outside the hydraulic machine, the measured value detection unit configured to detect an actual supply oil flow rate or its substitute numerical value for at least one of the hydraulic actuators. The control device is configured such that the first calculation unit calculates a control output value to become a basis for a current value to be applied to the electromagnetic proportional valve, according to a target engine rotation number detected by the target engine rotation number detection unit. The storage unit stores, for the at least one of the hydraulic actuators, a designed supply oil flow rate value or its substitute numerical value in a specific drive state for the at least one of the hydraulic actuators, the specific drive state being a state assumed when the at least one of the hydraulic actuators is driven with a specific engine rotation number and a specific manual operation amount. The second calculation unit calculates a correction coefficient for the control output value, by comparing the actual supply oil flow rate or its substitute numerical value detected by the measured value detection unit when the at least one of the hydraulic actuators is actually driven in the specific drive state, with the designed supply oil flow rate value or its substitute numerical value stored in the storage unit. The control output value calculated by the first calculation unit is corrected with the correction coefficient calculated by the second calculation unit.

A first aspect of the control device having the above configuration is such that the specific manual operation amount in the specific drive state is a maximum manual operation amount of the at least one of the hydraulic actuators, and the specific engine rotation number is an engine rotation number that yields a maximum control output value or its nearby value.

Alternatively a second aspect of the control device having the above configuration is such that the specific manual operation amount in the specific drive state is a maximum manual operation amount of the at least one of the hydraulic actuators, and the specific engine rotation number is an engine rotation number that yields a minimum control output value or its nearby value.

Alternatively a third aspect of the control device having the above configuration is such that: the specific drive state includes a first specific drive state and a second specific drive state; the specific manual operation amount in the first specific drive state and the second specific drive state is a maximum manual operation amount of the at least one of the hydraulic actuators; the specific engine rotation number in the first specific drive state is an engine rotation number that yields a maximum control output value or its nearby value; and the specific engine rotation number in the second specific drive state is an engine rotation number that yields a minimum control output value or its nearby value. In the control device, the second calculation unit calculates a correction coefficient for the control output value, by comparing the actual supply oil flow rate or its substitute numerical value detected by the measured value detection unit when the at least one of the hydraulic actuators is actually driven in each of the first specific drive state and the second specific drive state, with the designed supply oil flow rate value or its substitute numerical value stored in the storage unit.

Further, any of the above first to third aspects of the control device having the above configuration is such that the control device controls the flow rate of the oil ejected from the hydraulic pump, based on detection of a decrease in an actual engine rotation number. The control device stores a map of a first control output value corresponding to the target engine rotation number in another storage unit provided in the hydraulic machine, apart from the storage unit provided outside the hydraulic machine. In the first calculation unit, a first control output value corresponding to the target engine rotation number detected by the target engine rotation number detection unit is determined based on the map, a second control output value for controlling the flow rate of the oil ejected from the hydraulic pump based on detection of a decrease in the actual engine rotation number is calculated, the first control output value and the second control output value are combined to calculate a third control output value corresponding to the control output value, and the third control output value is corrected with the correction coefficient calculated by the second calculation unit.

Advantageous Effects of Invention

With the control device for a hydraulic machine as described above, a work for reducing variation in the operating performance of the hydraulic actuator for each hydraulic machine can be performed by controlling the control pressure in an existing load-sensing type pump control system. For example, there is no need for providing the hydraulic machine itself with an additional piece of equipment such as a pressure sensor to monitor the ejection pressure of the hydraulic pump. Therefore, the efficiency in a correction work for canceling errors in the product before its shipment or at a time of using the product for the first time can be improved at a low cost.

Performance errors and the like of means for generating a target differential pressure (a spring and the like of a load-sensing valve) or (a solenoid and the like of) the electromagnetic proportional valve for generating the control pressure used in the load-sensing type pump control system has an influence in the form of errors in the control pressure. To address errors in the pump ejection flow rate characteristic caused by such a factor, the control device of the first aspect is configured so that the above-described correction is performed by driving the pump at an engine rotation number that yields a maximum control pressure.

This device configuration can further improve the efficiency of correcting such errors in the pump ejection flow rate characteristic.

Performance errors and the like of (a meter-in throttle and the like of) a direction control valve for each hydraulic actuator has an influence in the form of errors in the operating speed of the hydraulic actuator, apart from the control pressure. To address errors in the operating speed of the hydraulic actuator due to the above factor, the control device of the second aspect is configured so that the above-described correction is performed by driving the pump with a condition that yields a minimum control pressure. This configuration minimizes influence of the error factor affecting the control pressure to the operating speed of the hydraulic actuator so that an error in the operating speed of the hydraulic actuator caused by a factor irrelevant to the control pressure can be reliably corrected, while being distinguished from the errors in the control pressure. By performing the correction work of the second aspect individually to the hydraulic actuator in the hydraulic machine, variation in the operating speed characteristic among a plurality of hydraulic machines can be corrected individually in their respective hydraulic actuators.

Further, the control device configured to perform work as in the third aspect can efficiently correct errors in the pump ejection flow rate characteristic caused by factors related to the control pressure and errors in the operating speed characteristic of the individual hydraulic actuator caused by factors irrelevant to the control pressure.

Further, when the control device is configured to perform pump control based on detection of a decrease in the actual engine rotation number, the first calculation unit calculates the third control output value by combining the first control output value for changing the target value of the differential pressure and the second control output value for performing pump control based on the decrease in the actual engine rotation number. This third control output value is corrected with the correction coefficient calculated in the second calculation unit. This configuration can reduce variation in the effect of the pump control that changes the target value of the differential pressure as is described above. Additionally, the configuration can reduce variation in the effect of the pump control performed when the actual engine rotation number is lowered.

DESCRIPTION OF EMBODIMENTS

Figure 1:
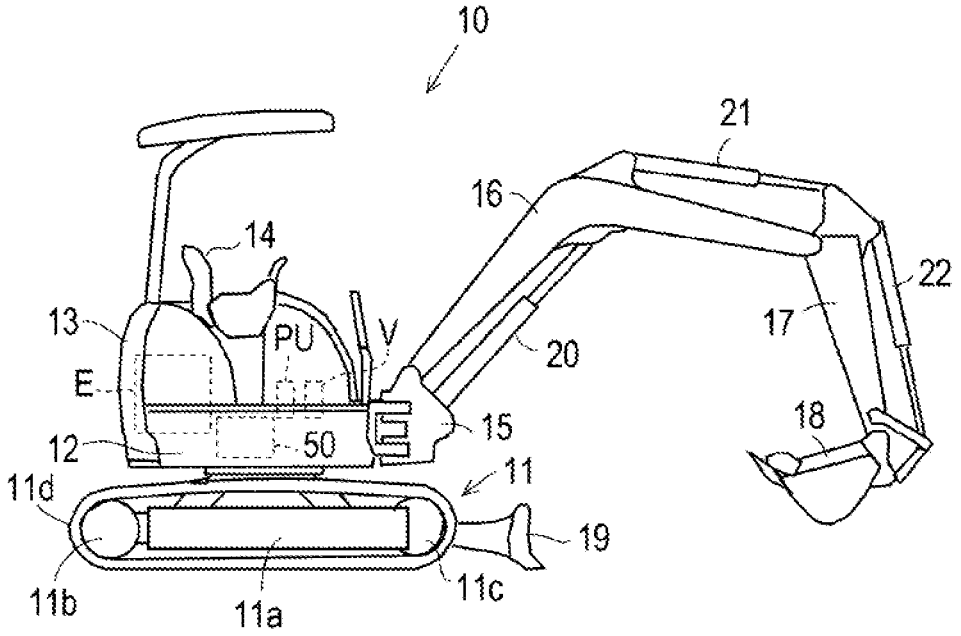
FIG. 1 A side view of an excavator work machine as an example of a hydraulic machine.

An overview configuration of a revolving excavator work machine 10 as an embodiment of a hydraulic machine shown in FIG. 1 will now be described. The revolving excavator work machine 10 includes a pair of left and right crawler type traveling devices 11. Each of the crawler type traveling devices 11 includes a truck frame 11*a* on which a driving sprocket 11*b* and a driven sprocket 11*c* are supported, with a crawler 11*d* wound on the driving sprocket 11*b* and the driven sprocket 11*c* so as to stretch therebetween. It may be conceivable that the traveling devices are wheel type traveling devices.

A revolving base 12 is mounted on the pair of left and right crawler type traveling devices 11 such that the revolving base 12 is rotatable about a vertical pivot relative to the both of the crawler type traveling devices 11. Mounted on the revolving base 12 is a hood 13 in which an engine E, a pump unit PU, a control valve unit V, and the like, are installed. Moreover, an operator's seat 14 is disposed on the revolving base 12. Manual operation tools such as levers and pedals for operating each hydraulic actuator (described later) are disposed on the front and lateral sides of the seat 14.

The revolving base 12 is provided with a boom bracket 15 that is rotatable in the horizontal direction relative to the revolving base 12. The boom bracket 15 pivotally supports a proximal end portion of a boom 16 such that the boom 16 can be rotated up and down. A distal end portion of the boom 16 pivotally supports a proximal end portion of the arm 17 such that the arm 17 can be rotated up and down. A distal end portion of the arm 17 pivotally supports a bucket 18 serving as a work machine such that the bucket 18 can be rotated up and down. As another work machine, an earth removing blade 19 is attached to the pair of left and right crawler type traveling devices 11 such that the earth removing blade 19 can be rotated up and down.

Figure 2:
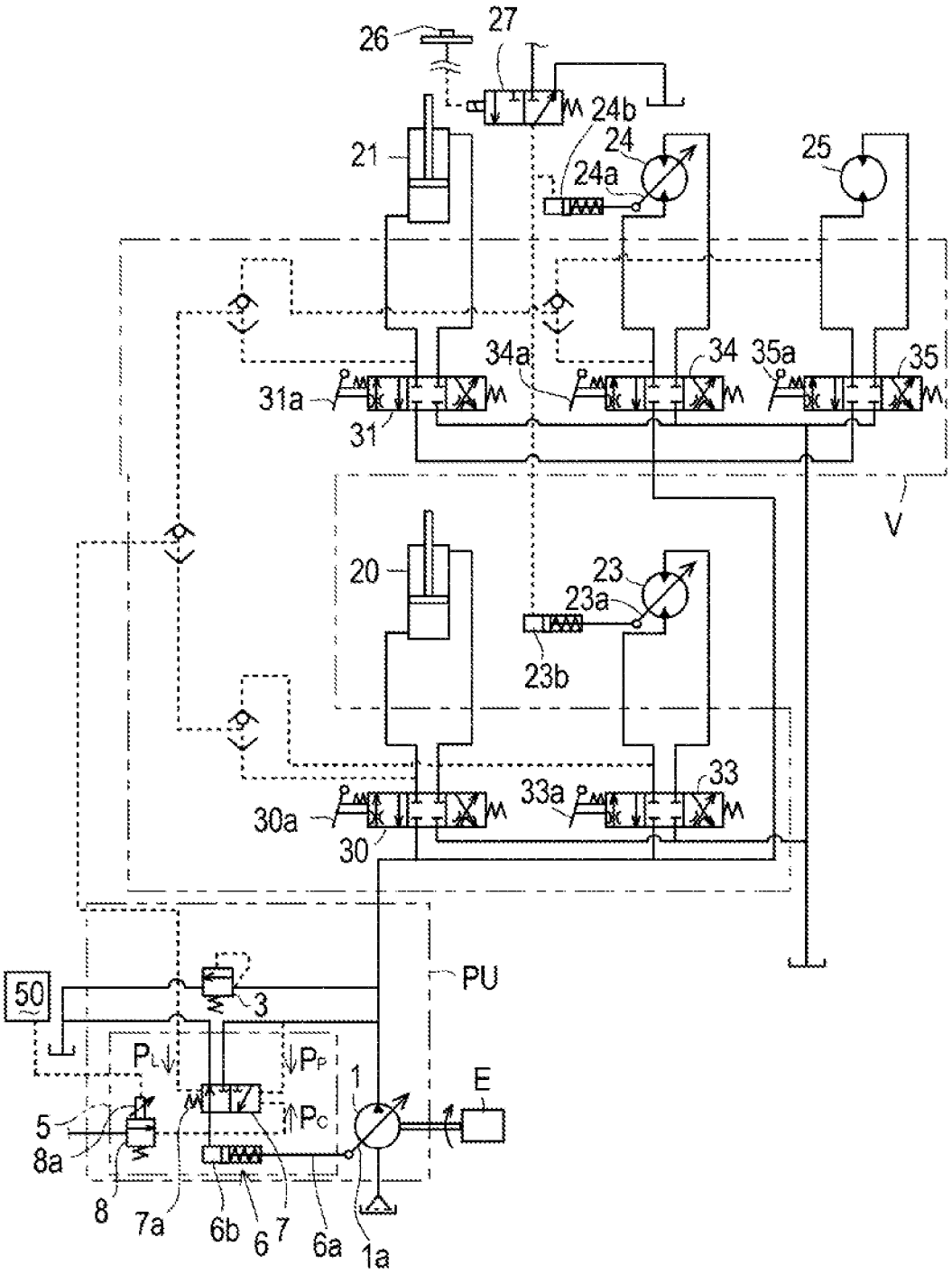
FIG. 2 A hydraulic circuit diagram showing a system for supplying pressure oil to a hydraulic actuator.

To drive the respective drive units of the revolving excavator work machine 10 mentioned above, the revolving excavator work machine 10 includes a plurality of hydraulic actuators as shown in FIG. 2. FIG. 1 shows typical hydraulic actuators, namely, a boom cylinder 20, an arm cylinder 21, and a bucket cylinder 22. Expansion and contraction of a piston rod of the boom cylinder 20 rotate the boom 16 up and down relative to the boom bracket 15. Expansion and contraction of a piston rod of the arm cylinder 21 rotate the arm 17 up and down relative to the boom 16. Expansion and contraction of a piston rod of the bucket cylinder 22 rotates the bucket 18 up and down relative to the arm 17.

In addition, the revolving excavator work machine 10 also includes expansion/contraction type hydraulic actuators constituted by hydraulic cylinders, such as a swing cylinder for horizontally turning the boom bracket 15 relative to the revolving base 12 and a blade cylinder for rotating the blade 19 up and down relative to the left and right crawler type traveling devices 11, though not shown in FIG. 1.

In addition, the revolving excavator work machine 10 also includes rotary type hydraulic actuators constituted by hydraulic motors, such as a traveling motor 23 (see FIG. 2) for driving the driving sprocket 11*b* of one of the left and right crawler type traveling devices 11, a traveling motor 24 (see FIG. 2) for driving the driving sprocket 11*b* of the other of the left and right crawler type traveling devices 11, and a revolving motor 25 (see FIG. 2) for revolving the revolving base 12 relative to the left and right crawler type traveling devices 11, though not shown in FIG. 1.

Referring to a hydraulic circuit diagram shown in FIG. 2, a description will be given to a supply control system for controlling a supply of oil ejected from a hydraulic pump to the respective hydraulic actuators included in the revolving excavator work machine 10. The revolving excavator work machine 10 includes a hydraulic pump 1 which is driven by the engine E. The hydraulic pump 1 supplies pressure oil to the boom cylinder 20, the arm cylinder 21, traveling motors 23, 24, and the revolving motor 25. In the hydraulic circuit diagram of FIG. 2, these are illustrated as typical hydraulic actuators, and illustration of other hydraulic actuators is omitted.

The hydraulic actuators individually include direction control valves, respectively. A collection of these direction control valves constitutes the control valve unit V.

Each of the direction control valves has its position switched by a manual operation on each of the manual operation tools mentioned above, to switch an oil supply direction. Each of the direction control valves has a meter-in throttle. The meter-in throttle has its opening degree variable in accordance with an operation amount on each manual operation tool. This, in combination with a control on an ejection flow rate from the hydraulic pump 1 performed by a load-sensing type pump control system 5 (described later), can cause a flow rate of the hydraulic oil supply to each hydraulic actuator to match a required flow rate of each hydraulic actuator, thus reducing an excess flow rate which is a loss because it is returned to a tank without working. In this manner, an increased operation efficiency of the hydraulic oil supply system for supplying hydraulic oil to the hydraulic actuator is attempted. In other words, a required flow rate of each hydraulic actuator is fixed by the opening degree of the meter-in throttle which is set according to an operation amount on the direction control valve of the hydraulic actuator.

In FIG. 2, the manual operation tools of the direction control valves 30, 31, 33, 34, 35 are illustrated as a boom operation lever 30*a*, an arm operation lever 31*a*, a first travel operation lever 33*a*, a second travel operation lever 34*a*, and a revolving operation lever 35*a*. Alternatively, however, the manual operation tools may be pedals or switches instead of levers, and may be integrated as appropriate. For example, it may be acceptable that one direction control valve is controlled by turning one lever in one direction, and another direction control valve is controlled by turning the one lever in another direction.

It may be also acceptable that the manual operation tools (levers 30*a*, 31*a*, 33*a*, 34*a*, 35*a*) are remote control (pilot) valves, so that the direction control valves 30, 31, 33, 34, 35 are controlled by pilot pressures caused by operations on the manual operation tools.

The revolving excavator work machine 10 also includes a speed change switch 26. The speed change switch 26 is linked to a movable swash plate 23*a* and a movable swash plate 24*a* of the traveling motor 23 and the traveling motor 24 which are variable displacement type hydraulic motors. As the speed change switch 26 is operated, the movable swash plates 23*a*, 24*a* are concurrently tilted. Here, the movable swash plates 23*a*, 24*a* of the traveling motors 23, 24 may alternatively be operated with a manual operation tool other than a switch, for example, with a pedal or a lever.

In this embodiment, the speed change switch 26 serves as an on/off switch. On-operation of the speed change switch 26 places the movable swash plates 23*a*, 24*a* into a small-inclination-angle (small-capacity) position for high-speed (normal-speed) setting, which is suitable for traveling on a road. Off-operation of the speed change switch 26 places the movable swash plates 23*a*, 24*a* into a large-inclination-angle (large-capacity) position for low-speed (work-speed) setting, which is suitable for traveling with work.

In more detail, the movable swash plates 23*a*, 24*a* are respectively linked to piston rods of swash plate control cylinders 23*b*, 24*b* which are hydraulic actuators. An open/close valve 27 is provided for supplying hydraulic oil to the swash plate control cylinders 23*b*, 24*b*. When the speed change switch 26 is turned on, the open/close valve 27 is opened by a pilot pressure, to supply hydraulic oil to the swash plate control cylinders 23*b*, 24*b*, so that the swash plate control cylinders 23*b*, 24*b* push and move the movable swash plates 23*a*, 24*a* into the small-inclination-angle position. When the speed change switch 26 is turned off, the open/close valve 27 brings back the hydraulic oil from the swash plate control cylinders 23*b*, 24*b*, so that the movable swash plates 23*a*, 24*a* are returned to the large-inclination-angle position due biasing with springs of the piston rods.

The hydraulic pump 1, a relief valve 3, and the load-sensing type pump control system 5 are combined to constitute the pump unit PU. The relief valve 3 prevents an excessive ejection pressure of the hydraulic pump 1. The load-sensing type pump control system 5 is constituted by a combination of a pump actuator 6, a load-sensing valve 7, and a pump control proportional valve 8.

The pump actuator 6 is constituted by a hydraulic cylinder, and its piston rod 6*a* is linked to a movable swash plate 1*a* of a first hydraulic pump 1. Expansion and contraction of the piston rod 6*a* cause the movable swash plate 1*a* to be tilted, thereby changing an inclination angle of the movable swash plate 1*a*. In this manner, an ejection flow rate $Q_P$ from the hydraulic pump 1 is changed.

The load-sensing valve 7 has a supply/discharge port that is in communication with a pressure oil chamber 6*b* of the pump actuator 6. The pressure oil chamber 6*b* is for expansion of the piston rod. The load-sensing valve 7 is biased by a spring 7*a*, in a direction of letting oil out of the pressure oil chamber 6*b* of the pump actuator 6, that is, in a direction of contracting the piston rod 6*a*. The direction in which the piston rod 6*a* contracts is toward the side where the inclination angle of the movable swash plate 1*a* increases, that is, the side where the ejection flow rate from the hydraulic pump 1 increases.

Oil ejected from the hydraulic pump 1 is partially received by the load-sensing valve 7, to serve as hydraulic oil to be supplied to the pressure oil chamber 6*b* of the pump actuator 6. Part of this oil is, against the spring 7*a*, applied to the load-sensing valve 7, to serve as a pilot pressure that is based on an ejection pressure $P_P$ of the hydraulic pump 1. The ejection pressure $P_P$ serving as the pilot pressure applied to the load-sensing valve 7 is exerted so as to switch the load-sensing valve 7 in a direction of supplying oil to the pressure oil chamber 6*b* of the pump actuator 6, that is, in a direction of expanding the piston rod 6*a*.

From all hydraulic pressures at secondary sides after the meter-in throttles of all the direction control valves, that is, from all hydraulic pressures of supply oils from the direction control valves to the hydraulic actuators, a maximum hydraulic pressure which means a maximum load pressure $P_L$ is extracted, and is applied to the load-sensing valve 7 to serve as a pilot pressure against the ejection pressure $P_P$.

Here, a flow rate of oil passing through the meter-in throttle of each direction control valve and supplied to the corresponding hydraulic actuator, that is, a required flow rate $Q_R$ of each hydraulic actuator is calculated by mathematical expressions indicated as "Math. 1" below.

$$Q_R = cA\sqrt{2\Delta P/\rho}$$

$$\Delta P_0 = P_P - P_L$$

$$\Delta P = \Delta P_0 - P_C \qquad \text{[Math. 1]}$$

$Q_R$=required flow rate
c=coefficient
A=meterin throttle opening degree (cross-sectional area)
ΔP=differential pressure
ρ=density
$\Delta P_0$=uncontrolled differential pressure (specified differential pressure)
$P_P$=ejection pressure
$P_L$=(maximum) load pressure
$P_C$=control pressure Assuming that the control pressure $P_C$ (described later) is zero, the position of the load-sensing valve 7 is switched depending on whether the differential pressure ΔP (uncontrolled differential pressure $\Delta P_0$) between the ejection pressure $P_P$ and the maximum load pressure $P_L$ is higher or lower than a spring force $F_S$ of the spring 7*a*. When the differential pressure ΔP is higher than the spring force $F_S$, the piston rod 6*a* of the pump actuator 6 expands so that the inclination angle of the movable swash plate 1*a* decreases to reduce the ejection flow rate $Q_P$ of the hydraulic pump 1. When the spring force $F_S$ is higher than the differential pressure ΔP, the piston rod 6*a* of the pump actuator 6 contracts so that the inclination angle of the movable swash plate 1*a* increases to increase the ejection flow rate $Q_P$ of the hydraulic pump 1.

The expressions above indicate that the required flow rate $Q_R$ is proportional to the cross-sectional area A (opening degree) of the meter-in throttle, if the differential pressure ΔP is constant. The opening degree A of the meter-in throttle is determined according to an operation amount on the manual operation tool of the direction control valve in which this meter-in throttle is provided. In other words, the required flow rate $Q_R$ is a value that is determined irrespective of a change in the engine rotation number. The required flow rate $Q_R$ is kept constant, as long as the operation amount is kept constant.

If, due to an insufficient ejection flow rate $Q_P$ from the hydraulic pump 1, a supply flow rate to an operation-object hydraulic actuator through the meter-in throttle of the direction control valve is less than the required flow rate $Q_R$ of the hydraulic actuator; the differential pressure ΔP decreases and falls below the spring force $F_S$ so that the load-sensing valve 7 is operated in the direction of increasing the inclination angle of the movable swash plate 1*a*, which increases the ejection flow rate $Q_P$ from the hydraulic pump 1, thus increasing the supply flow rate to this hydraulic actuator. In this manner, a driving speed of this hydraulic actuator can be increased to a speed set by the manual operation tool of this hydraulic actuator.

If the ejection flow rate $Q_P$ from the hydraulic pump 1 is too high, the differential pressure ΔP increases and exceeds the spring force $F_S$ so that the load-sensing valve 7 is operated in the direction of reducing the inclination angle of the movable swash plate 1*a*, which reduces the ejection flow rate $Q_P$ from the hydraulic pump 1, thus reducing the supply flow rate to the hydraulic actuator to a value corresponding to the required flow rate $Q_R$ of this hydraulic actuator. In this manner, an excessive supply amount of hydraulic oil can be reduced.

Even when, for example, an operation amount on each lever (a spool stroke of each direction control valve) is at its maximum (that is, the opening degree of the meter-in throttle of each direction control valve is at its maximum), the required flow rate $Q_R$ varies depending on an operation-object hydraulic actuator. For example, a required flow rate of the boom cylinder 20 for turning the boom 16 is high. On the other hand, a required flow rate of the revolving motor 25 for turning the revolving base 12 is not so high.

Although the required flow rates of the individual actuators are different from one another, controlling the inclination angle of the movable swash plate 1*a* in such a manner that the differential pressure ΔP in the load-sensing valve 7 can be equal to a differential pressure (target differential pressure) specified by the spring force $F_S$ of the spring 7*a* as mentioned above allows the hydraulic pump 1 to supply oil with a flow rate corresponding to a required flow rate specified by the direction control valve of each actuator. That is, for all the actuators, the inclination angle (pump capacity) of the movable swash plate 1*a* of the hydraulic pump 1 is controlled with targeting a ratio ($Q/Q_R$) (hereinafter referred to as "supply/required flow rate ratio") of the supply flow rate Q to the required flow rate $Q_R$ being 1 (hereinafter, this target value will be referred to as "target supply/required flow rate ratio Rq").

If the inclination angle of the movable swash plate 1*a* is set constant, the ejection flow rate $Q_P$ from the hydraulic pump 1 is changed with a change in a target engine rotation number N.

Supply flow rate characteristics in a case of alternating turning of the boom 16 with the boom operation lever 30*a* operated to its maximum operation amount and turning of the revolving base 12 with the revolving operation lever 35*a* operated to its maximum operation amount will now be discussed with reference to FIG. 3, on the assumption that the target differential pressure ΔP in the load-sensing valve 7 is equal to the specified differential pressure $\Delta P_0$ specified by the spring force $F_S$ irrespective of a change in the engine rotation number (that is, over the entire region of the engine rotation number, for driving of all the actuators, the movable swash plate 1*a* of the hydraulic pump 1 is controlled with targeting the target supply/required flow rate ratio Rq being 1 (Rq=1)).

Figure 3:
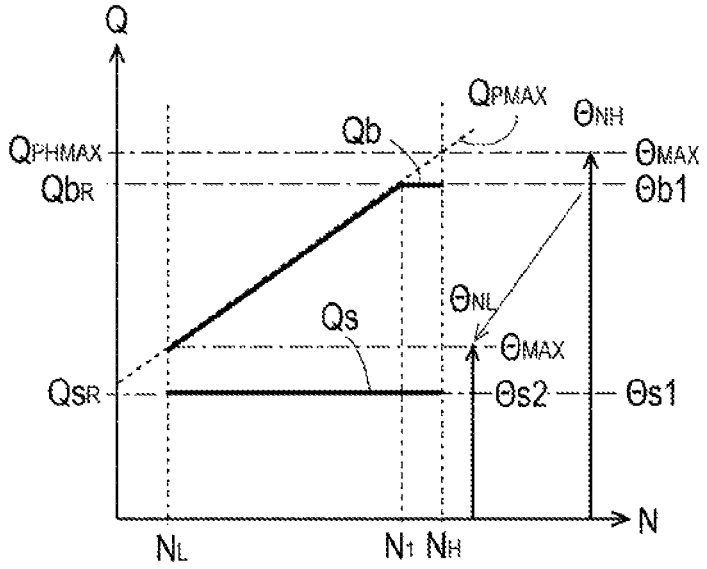
FIG. 3 A graph of a supply flow rate to the hydraulic actuator relative to an engine rotation number under a load-sensing pump control with no control pressure applied.

FIG. 3 shows characteristics of the supply flow rate Q to the hydraulic actuator over the entire region of the target engine rotation number N which is set for operations of the hydraulic actuators (shown herein are characteristics of a supply flow rate Qb to the boom cylinder 20 and a supply flow rate Qs to a revolving motor 25). A minimum value and a maximum value of the region of the target engine rotation number N are a low idling rotation number $N_L$ and a high idling rotation number $N_H$, respectively. The inclination angle of the movable swash plate 1*a* is indicated by $\Theta_{NH}$ and $\Theta_{NL}$. $\Theta_{NH}$ represents the inclination angle at a time of driving the engine with the high idling rotation number $N_H$ (hereinafter referred to as "at a time of high idling rotation"). $\Theta_{NL}$ represents the inclination angle at a time of driving the engine with the low idling rotation number $N_L$ (hereinafter referred to as "at a time of low idling rotation").

FIG. 3 shows a change in a maximum rate $Q_{PMAX}$ of the ejection flow rate $Q_P$ (hereinafter, maximum ejection flow rate $Q_{PMAX}$) over the engine rotation-number region, in a case where the movable swash plate 1*a* is at its maximum inclination angle position. The supply flow rate Q is a flow rate that is actually supplied to each actuator via the direction control valve. As long as each actuator is driven solely; for each driving, the load-sensing type pump control system 5 controls the ejection flow rate $Q_P$ from the hydraulic pump 1 such that the ejection flow rate $Q_P$ can correspond to the required flow rate $Q_R$. As a result, therefore, the ejection flow rate $Q_P$=the supply flow rate Q can be established. The following description assumes this.

As long as the target differential pressure ΔP is set to the specified differential pressure $\Delta P_0$; each time each actuator is operated, the inclination angle of the movable swash plate 1*a* is controlled such that oil ejected from the hydraulic pump 1 can be supplied so as to satisfy the required flow rate $Q_R$ of the actuator, that is, such that the target supply/required flow rate ratio Rq can be 1.

A required flow rate $Qb_R$ of the boom cylinder 20 with the boom operation lever 30*a* operated to its maximum operation amount is determined by a maximum opening area of the meter-in throttle of the direction control valve 30, i.e., a maximum value $S_{MAX}$ (see FIG. 7) of the spool stroke. The required flow rate $Qb_R$ is lower than a pump maximum ejection flow rate $Q_{PHMAX}$ at a time of high idling rotation. Thus, an inclination angle Θb1 of the movable swash plate 1*a* in a case of driving the boom 16 at a time of high idling rotation is equal to or smaller than a maximum inclination angle $\Theta_{MAX}$ (in this embodiment, smaller than the maximum inclination angle $\Theta_{MAX}$). Thus, at a time of high idling rotation, the supply flow rate Qb to the boom cylinder 20 is $Qb_R$ that is the same as the required flow rate. Thus, at a time of high idling rotation, the supply flow rate Qb to the boom cylinder 20 has a maximum value, and a driving speed of the boom 16 exerted at this time is a maximum driving speed.

The required flow rate $Qb_R$ of the boom cylinder 20 is constant while the required flow rate $Qb_R$ of the boom cylinder 20 is relatively higher among all the actuators. Therefore, as long as the operation amount on the boom operation lever 30*a* is kept at the maximum value, the maximum ejection flow rate $Q_{PMAX}$ decreases as the target engine rotation number N decreases from the high idling rotation number $N_H$, and eventually (at a time point when the target engine rotation number N reaches $N_1$ in FIG. 3), the maximum ejection flow rate $Q_{PMAX}$ itself becomes equal to the required flow rate $Qb_R$ of the boom cylinder 20. While the target engine rotation number N is decreasing from $N_H$ to $N_1$, the load-sensing type pump control system 5 increases the inclination angle of the movable swash plate 1*a* in order to attain the target supply/required flow rate ratio Rq (=1) of the boom cylinder 20. At a time point when the target engine rotation number N=$N_1$, the inclination angle of the movable swash plate 1*a* reaches the maximum inclination angle $\Theta_{MAX}$.

While the target engine rotation number N having fallen below $N_1$ is decreasing to the low idling rotation number $N_L$, the maximum ejection flow rate $Q_{PMAX}$ falls below the required flow rate $Qb_R$ of the boom cylinder 20. Consequently, as the engine rotation number decreases, the supply flow rate Qb to the boom cylinder 20 overlaps the maximum ejection flow rate $Q_{PMAX}$ and decreases together with the maximum ejection flow rate $Q_{PMAX}$. Along with the decrease in the supply flow rate Qb, the operating speed of the boom cylinder 20 which means the driving speed of the boom 16 decreases.

A required flow rate $Qs_R$ of the revolving motor 25 with the revolving operation lever 35*a* operated to its maximum operation amount is determined by a maximum opening area of the meter-in throttle of the direction control valve 35, i.e., a maximum value $S_{MAX}$ (see FIG. 7) of the spool stroke S. To satisfy the required flow rate $Qs_R$, at a time of high idling rotation, the movable swash plate 1*a* of the hydraulic pump 1 is placed with an inclination angle Θs1, so that the revolving motor 25 is operated at its maximum speed, that is, the revolving base 12 is revolved at its maximum speed. At a time of high idling rotation, therefore, alternating the driving of the boom cylinder 20 with the boom operation lever 30*a* operated to its maximum operation amount and the driving of the revolving motor 25 with the revolving operation lever 35*a* operated to its maximum operation amount allows both the boom 16 and the revolving base 12 to be turned at their respective maximum driving speeds.

The required flow rate $Qs_R$ of the revolving motor 25 with the revolving operation lever 35*a* operated to its maximum operation amount is considerably lower than the required flow rate $Qb_R$ of the boom cylinder 20 with the boom operation lever 30*a* operated to its maximum operation amount. At a time of high idling rotation, the inclination angle ΘH of the movable swash plate 1*a* is considerably smaller than the inclination angle Θb1 in a case of operating the boom cylinder 20 with the boom operation lever 30*a* operated to its maximum operation amount. Thus, there is a considerable tilt allowable range before reaching the maximum inclination angle $\Theta_{MAX}$.

While the target engine rotation number N is decreasing from the high idling rotation number $N_H$ with the amount of operation on the revolving operation lever 35*a* being kept at the maximum operation amount, the movable swash plate 1*a* is tilted in the direction of increasing the inclination angle Θ such that the supply flow rate Qs can satisfy the required flow rate $Qs_R$, under a pump control that the load-sensing type pump control system 5 performs with targeting the target supply/required flow rate ratio Rq being 1. Since the tilt allowable range is wide, the maximum inclination angle $\Theta_{MAX}$ is not reached even though the target engine rotation number N decreases to the low idling rotation number $N_L$ so that the movable swash plate 1*a* is tilted in the angle increasing direction to the maximum and eventually reaches an inclination angle Θs2. Accordingly, while the target engine rotation number N is decreasing to the low idling rotation number $N_L$, the supply flow rate Qs to the revolving motor 25 satisfies the required flow rate $Qs_R$, and the operating speed of the revolving motor 25 is kept at the maximum speed so that the revolving speed of the revolving base 12 is also kept at the maximum speed.

As described above, the driving speed of the boom 16 at a time of low idling rotation is lower than that at a time of high idling rotation, whereas the driving speed of the revolving base 12 at a time of low idling rotation is kept equal to that at a time of high idling rotation. In this situation, if an operator turns the boom 16 at a slow speed on the assumption that the engine E is driven with the low idling rotation number $N_L$ and then shifts to an operation of turning the revolving base 12, the turning speed is higher than the operator has expected, which makes the operator feel uncomfortable in performing the operation. Moreover, even though the operator desires to move the revolving base 12 at a minute speed, the revolving speed of the revolving base 12 is not changed by reduction in the engine rotation number. The speed can be adjusted only by adjustment of the revolving operation lever 35*a*. Thus, a delicate revolving operation of the machine is difficult.

If the target supply/required flow rate ratios Rq for all the actuators are reduced at a constant ratio so as to correspond to a decrement of the target engine rotation number N, and the load-sensing type pump control system 5 performs the pump control; the supply flow rates Q to the respective actuators at a time of operating the actuators are uniformly reduced so as to correspond to the decrement of the target engine rotation number N, irrespective of high/low of their required flow rates $Q_R$. Accordingly, the driving speeds of the respective drive units driven by the respective actuators can be reduced uniformly.

For example, in a case of alternating turning of the boom 16 and turning of the revolving base 12 as described above; at a time of low idling rotation, the turning of the revolving base 12 can be made slow down with a sensation equivalent to slow-down of the turning of the boom 16 as compared to at a time of high idling rotation. Thus, an inconvenience that the operator feels as if the turning of the revolving base 12 is relatively high as compared to the turning of the boom 16 can be removed.

Under such a pump control, the driving speed of the revolving motor 25 decreases as the engine rotation number decreases, and therefore it is possible to delicately adjust the position of the revolving base 12 by minutely adjusting the speed of the revolving motor 25 based on increase and decrease in the engine rotation number, which would be impossible if the pump control is performed with the target supply/required flow rate ratio Rq=1 being fixed.

To reduce the target supply/required flow rate ratios Rq for all the actuators in accordance with a decrease in the engine rotation number, the load-sensing type pump control system 5 is provided with an electromagnetic proportional valve serving as the pump control proportional valve 8. Oil from the pump control proportional valve 8 is, as pilot pressure oil, supplied to the load-sensing valve 7. A secondary pressure of the load-sensing valve 7 having this oil is the control pressure $P_C$ which is applied to the load-sensing valve 7 against the maximum load pressure $P_L$.

A differential pressure between the ejection pressure $P_P$ and the maximum load pressure $P_L$ required to balance the spring force $F_S$, which means the target differential pressure ΔP, is reduced by an amount corresponding to addition of the control pressure $P_C$. Accordingly, as the control pressure $P_C$ increases, the load-sensing valve 7 operates in the direction of reducing the inclination angle of the movable swash plate 1*a*, so that the ejection flow rate from the hydraulic pump 1 decreases.

The control pressure $P_C$ is determined by a current value that is applied to a solenoid 8*a* of the pump control proportional valve 8 which is an electromagnetic proportional valve. This value is defined as a first control output value C1. For the direction control valve of each hydraulic actuator, a correlation of the required flow rate of each hydraulic actuator with the operation amount on the manual operation tool of this hydraulic actuator is estimated with respect to each engine rotation number. A correlation map of the first control output value C1 corresponding to the engine rotation number is prepared so as to achieve the estimated correlation. This map is stored in a storage unit of the controller that controls the control output value to be applied to the pump control proportional valve 8. This is how to enable the supply/required flow rate ratios of all the hydraulic actuators to be controlled so as to correspond to a change in the engine rotation number (that is, how to enable a control under which the driving speeds of the plurality of actuators decrease at the same ratio in accordance with the engine rotation number), as described above. Based on this map, the target values of the supply/required flow rate ratios for all the hydraulic actuators, which intrinsically should be 1, are reduced in accordance with a decrease in the engine rotation number. This control will hereinafter be referred to as "speed reducing control" in the following description.

Figure 4:
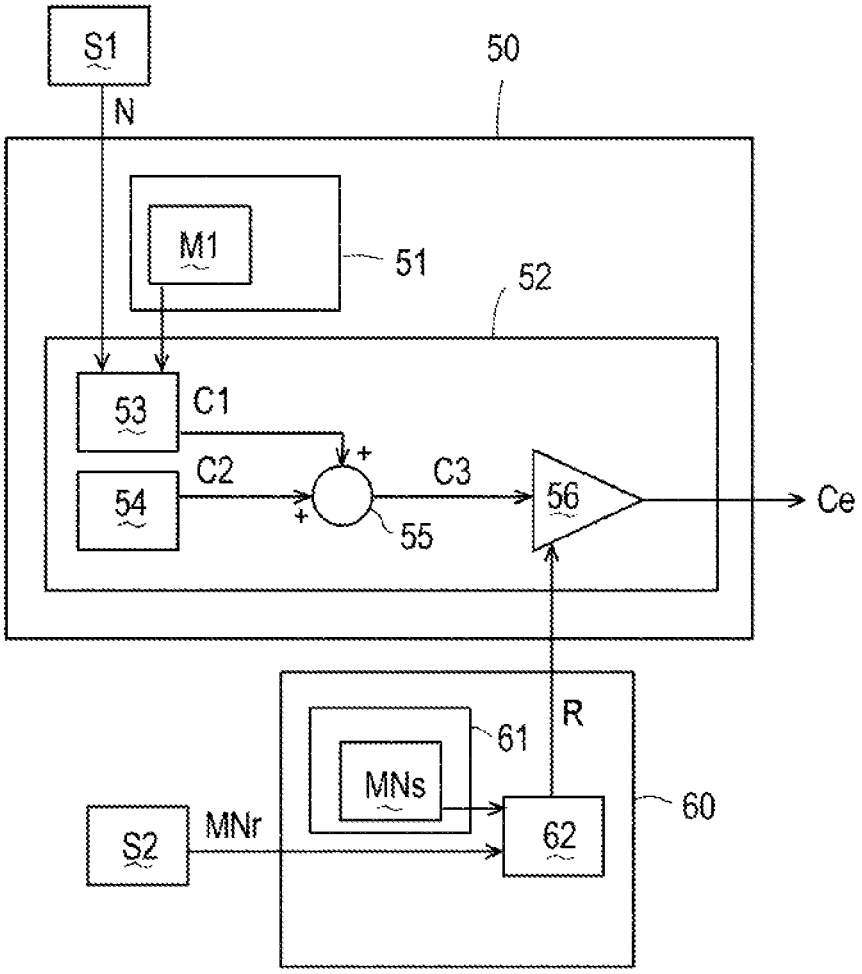
FIG. 4 A block diagram, showing a correction control system for a control output value.

In the revolving excavator work machine 10, a controller 50 configured to determine the first control output value C1 as shown in FIG. 2 and FIG. 4 is provided. The controller 50 includes a storage unit 51 that stores therein a control output value map M1 (FIG. 5(*a*)) showing a correlation of the first control output value C1 with the target engine rotation number N, for every actuator.

The control output value map M1, which is stored in the storage unit 51, is prepared for each work mode which can be set in the revolving excavator work machine 10, and the control output value map M1 corresponding to the set work mode is selected. When the target engine rotation number N is set, the first control output value C1 is determined based on application of the value to the selected control output value map M1.

Figure 5:
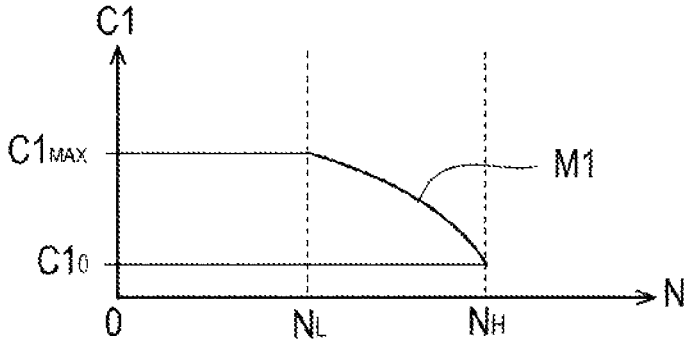
FIG. 5 Maps and graphs concerning the load-sensing type pump control, in which FIG. 5(*a*) is a map of a control output value, FIG. 5(*b*) is a graph of the control pressure, and FIG. 5(*c*) is a graph of a target differential pressure.
Figure 5:
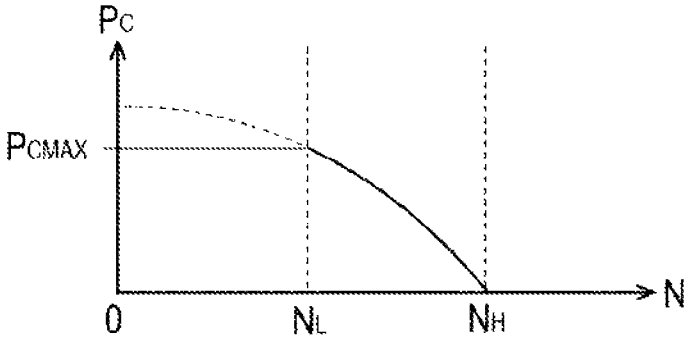
Figure 5:
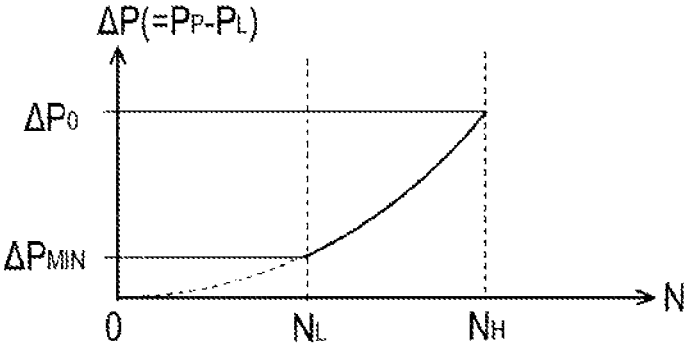
Figure 6:
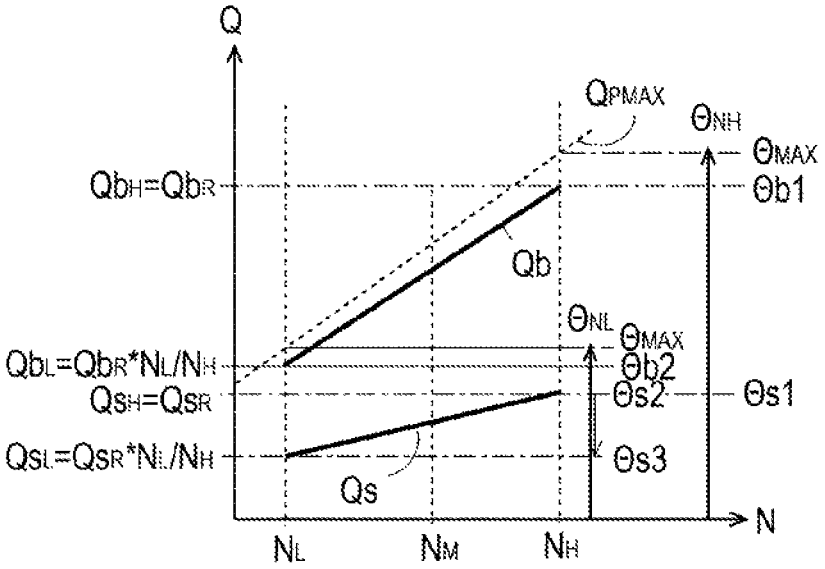
FIG. 6 A graph of the supply flow rate to the hydraulic actuator relative to the engine rotation number under the load-sensing type pump control with a control pressure applied.
Figure 7:
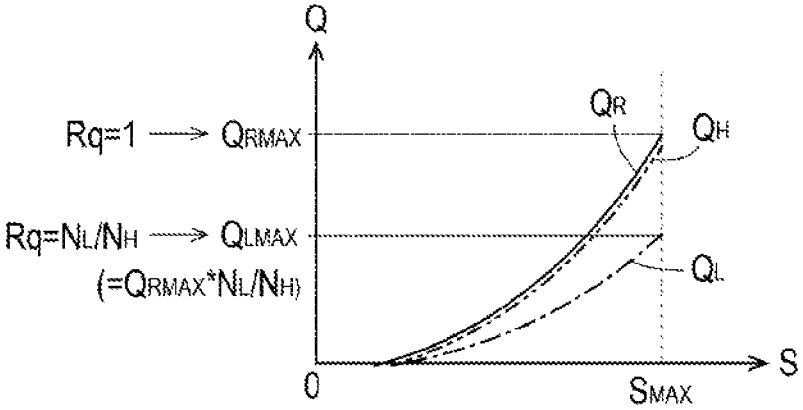
FIG. 7 A graph of the supply flow rate to the hydraulic actuator relative to an operation amount under the load-sensing type pump control.

Referring to FIG. 5 to FIG. 7, a description will be given to a map of the first control output value C1, and a manner of the pump control based on the map, in relation to the "speed reducing control".

FIG. 5(*a*) shows the control output value map M1 indicating a change in the first control output value C1 along with a decrease of the target engine rotation number N from the high idling rotation number $N_H$ to the low idling rotation number $N_L$. Here, a configuration of the control output value map M1, which is typical one in the group of maps prepared for each of several modes that can be set in the revolving excavator work machine 10 as mentioned above, will be described.

In the control output value map M1, the first control output value C1 at a time of high idling rotation serves as a minimum value $C1_0$ (which means a value that causes the secondary pressure (control pressure $P_C$) of the pump control proportional valve 8 to be zero), the first control output value C1 at a time of low idling rotation serves as a maximum value $C1_{MAX}$, and the first control output value C1 increases as the target engine rotation number N decreases from the high idling rotation number $N_H$ to the low idling rotation number $N_L$.

FIG. 5(*b*) and FIG. 5(*c*) show changes in pressures applied to the load-sensing valve 7 in a case of changing the first control output value C1 for the pump control proportional valve 8 (the current value applied to the solenoid 8*a*) in accordance with a change in the target engine rotation number N based on the control output value map M1. FIG. 5(*b*) shows a change in the secondary pressure of the pump control proportional valve 8, that is, a change in the control pressure $P_C$. FIG. 5(*c*) shows a change in the target value for the differential pressure ΔP between the ejection pressure $P_P$ and the maximum load pressure $P_L$, that is, a change in the target differential pressure ΔP.

At a time of high idling rotation, the first control output value C1 is the minimum value $C1_0$, and therefore the control pressure $P_C$ is 0. Accordingly, the target differential pressure ΔP is the specified differential pressure $\Delta P_0$ which is equal to the spring force $F_S$ of the load-sensing valve 7. As the target engine rotation number N decreases from the high idling rotation number $N_H$ to the low idling rotation number $N_L$, the first control output value C1 increases so that the control pressure $P_C$ increases, and accordingly, the target differential pressure ΔP decreases. The target differential pressure ΔP at a time of low idling rotation is defined as a minimum target differential pressure $\Delta P_{MIN}$.

FIG. 6 is a diagram showing an effect of the "speed reducing control" that appears in the supply flow rate characteristics of the hydraulic actuators in accordance with a change in the engine rotation number. This diagram is on the assumption of a work state in which two hydraulic actuators (herein, the boom cylinder 20 and the revolving motor 25) having different required flow rates are operated alternately (that is, each of them is operated solely). Illustrated are a graph of the supply flow rate Qb in a case of driving the boom cylinder 20 whose required flow rate is high and a graph of the supply flow rate Qs in a case of driving the revolving motor 25 whose required flow rate is low. Also illustrated is a graph of the maximum ejection flow rate $Q_{PMAX}$, similarly to FIG. 3. They are values obtained when the operation amounts on the respective operation levers 30*a*, 35*a* are maximum (when spool strokes S of the respective direction control valves 30, 35 are the maximum values $S_{MAX}$), that is, when their required flow rates $Qb_R$, $Qs_R$ are maximum. The inclination angle of the movable swash plate 1*a* is represented as $\Theta_{NH}$ at a time of high idling rotation, and as $\Theta_{NL}$ at a time of low idling rotation, as mentioned above.

At a time of high idling rotation ($N=N_H$), the first control output value C1 for the pump control proportional valve 8 is the minimum value $C1_0$, and thus no control pressure $P_C$ is applied to the load-sensing valve 7 (that is, the target differential pressure ΔP is the specified differential pressure $\Delta P_0$). For each actuator, therefore, the movable swash plate 1*a* is controlled with the target supply/required flow rate ratio Rq=1. Accordingly, as in the case of high idling rotation described with reference to FIG. 3, when the boom cylinder 20 is driven, the movable swash plate 1*a* reaches the inclination angle Θb1 so that the supply flow rate $Qb_H$ satisfies the required flow rate $Qb_R$ ($Qb_H=Qb_R$), to drive the boom 16 at its maximum speed, whereas when the revolving motor 25 is driven, the movable swash plate 1*a* reaches the inclination angle Θs1 so that the supply flow rate $Qs_H$ satisfies the required flow rate $Qs_R$ ($Qs_H=Qs_R$), to revolve the revolving base 12 at its maximum speed.

At a time of low idling rotation ($N=N_L$), on the other hand, the first control output value C1 for the pump control proportional valve 8 is $C1_{MAX}$ which is greater than the minimum value $C1_0$, and thus a control pressure $P_C$ is applied to the load-sensing valve 7, so that the target differential pressure ΔP is [the specified differential pressure $\Delta P_0$−the control pressure $P_C$], which is lower than the target differential pressure ΔP at a time of high idling rotation. Accordingly, the target supply/required flow rate ratio Rq of each actuator is set to a value smaller than 1 which is the target value at a time of high idling rotation. Here, $RqL=N_L/N_H$ is set, where RqL is the target supply/required flow rate ratio Rq at a time of low idling rotation. Thus, when the boom cylinder 20 is driven, the inclination angle $\Theta_{NL}$ of the movable swash plate 1*a* is kept as low as Θb2, so that the supply flow rate $Qb_L$ for turning decreases $Qb_R \times N_L/N_H$. On the other hand, when the revolving motor 25 is driven, the inclination angle $\Theta_{NL}$ of the movable swash plate 1*a* would be able to reach Θs2 if the speed reducing control was not performed, but actually, the inclination angle $\Theta_{NL}$ is kept as low as Θs3 which is lower than Θs2, so that the supply flow rate $Qs_L$ decreases $Qs_R \times N_L/N_H$. In this manner, for both the boom cylinder 20 and the revolving motor 25, the supply flow rates Q decrease at the same ratio along with a decrease in the engine rotation number from the high idling rotation number to the low idling rotation number, and the driving speeds of the boom cylinder 20 and the revolving motor 25 also decrease at the same ratio.

In a case of driving the engine E with an arbitrary engine rotation number $N_M$ intermediate between the high idling rotation number $N_H$ and the low idling rotation number $N_L$, the target supply/required flow rate ratio Rq in driving each actuator is set to $N_M/N_H$. The arbitrary engine rotation number $N_M$ is a numerical value that decreases toward the low idling rotation number $N_L$. Thus, as the target engine rotation number N decreases toward the low idling rotation number $N_L$, the target supply/required flow rate ratio Rq in driving each actuator decreases.

Setting the target supply/required flow rate ratio Rq corresponding to the arbitrary engine rotation number $N_M$ to $N_M/N_H$ is one example of causing a decrease in the supply flow rate Q in driving each actuator, which occurs along with a decrease in the target engine rotation number N, to be according to a decrease in the engine rotation number. Other numerical values may be set. The important thing is that the target supply/required flow rate ratio Rq decreases along with a decrease in the target engine rotation number N from the high idling rotation number $N_H$, and that each time each actuator is driven, the effect of decreasing the target supply/required flow rate ratio Rq in accordance with a decrease in the engine rotation number can be obtained for all the actuators.

In the case described with reference to FIG. 3, for the boom cylinder 20 whose required flow rate $Qb_R$ with the boom operation lever 30*a* operated to the maximum operation amount is high, the target differential pressure ΔP is not changed (the target supply/required flow rate ratio Rq=1 is maintained) even though the engine rotation number is changed. In this case, a decrease in the supply flow rate Qb along with a decrease in the target engine rotation number N is almost attributable to a decrease in the maximum ejection flow rate $Q_{PMAX}$ along with the degrease in the target engine rotation number N. Referring to FIG. 6, it can be seen that: if the supply flow rate Qb for the boom cylinder 20 with the boom operation lever 30*a* operated to the maximum operation amount is set to $Qb_R \times N_M/N_H$ so as to correspond to the arbitrary engine rotation number $N_M$, a decrease in the supply flow rate Qb along with a decrease in the engine rotation number roughly follows a decrease in the maximum ejection flow rate $Q_{PMAX}$.

In the case described with reference to FIG. 3, for the revolving motor 25 whose required flow rate $Qs_R$ with the revolving operation lever 35*a* operated to the maximum operation amount is low, the target differential pressure ΔP is not changed (the target supply/required flow rate ratio Rq=1 is maintained) even though the engine rotation number is changed. In this case, the supply flow rate Qs is kept at a value that satisfies the required flow rate $Qs_R$ over the entire region of the target engine rotation number N from the high idling rotation number $N_H$ to the low idling rotation number $N_L$. Referring to FIG. 6, it can be seen that: if the supply flow rate Qs for the revolving motor 25 with the revolving operation lever 35*a* operated to the maximum operation amount is set to $Qs_R \times N_M/N_H$ so as to correspond to the arbitrary engine rotation number $N_M$, the supply flow rate Qs decreases along with a decrease in the engine rotation number, and the decrease in the supply flow rate Qs is according to the decrease in the engine rotation number.

The effect of decreasing the target supply/required flow rate ratio Rq by increasing the first control output value C1 shown in FIG. 5(*a*) along with a decrease in the engine rotation number is, in appearance, significantly exerted for an actuator required flow rate is low, because a supply flow rate for such an actuator decreases though it has been conventionally kept to satisfy a required flow rate even at a time of low-speed rotation of the engine. The effect is not obviously exerted for an actuator whose required flow rate is high, because a decrease in a supply flow rate for such an actuator along with a decrease in the engine rotation number is similar to a decrease in the maximum ejection flow rate $Q_{PMAX}$. The fact, however, remains that the effect of controlling the first control output value C1, the control pressure $P_C$, and the target differential pressure ΔP shown in FIG. 5(*a*) to FIG. 5(*c*) in accordance with a change in the engine rotation number can also be obtained for a hydraulic actuator whose required flow rate is high, such as the boom cylinder 20. Thus, for every actuator, the effect of decreasing the driving speed of the actuator by decreasing the target supply/required flow rate ratio Rq in accordance with the engine rotation number can be obtained upon driving the actuator.

Consequently, for all the actuators, a phenomenon is avoided that: with lever positions of the actuators unchanged, the driving speeds of the actuators decrease uniformly (for example, according to a decrease in the engine rotation number) along with a decrease in the engine rotation number, to make the operator feel as if driving of one actuator is relatively high as compared to another actuator while the engine is driven with a low engine rotation number.

For an actuator whose required flow rate is low, such as the revolving motor 25, the speed of the actuator can be minutely adjusted by changing the engine rotation number, which is impossible if the target supply/required flow rate ratio Rq is fixed to 1.

Regarding the speed reducing control in accordance with a change in the engine rotation number, FIG. 7 shows characteristics of the required flow rate $Q_R$ and the supply flow rate Q relative to a lever operation amount on a certain hydraulic actuator, that is, relative to a spool stroke S of a direction control valve of the actuator.

The required flow rate $Q_R$ increases as the spool stroke S increases, and reaches a maximum value $Q_{PMAX}$ when the spool stroke S is a maximum value $S_{MAX}$. Without any control output under the speed reducing control, as in the case of high idling rotation, the supply/required flow rate ratio is 1 so that a supply flow rate $Q_H$ is coincident with the required flow rate $Q_R$, unless the required flow rate $Q_R$ exceeds the maximum pump ejection flow rate $Q_{PMAX}$.

On the other hand, a supply flow rate $Q_L$ at a time of low idling rotation has a value obtained by multiplying the required flow rate $Q_R$ by a constant ratio (in the above embodiment, $N_L/N_H$) less than 1, because of the speed reducing control effect. That is, when the spool stroke S is the maximum value $S_{MAX}$, $Q_{LMAX}=Q_{RMAX}\times N_L/N_H$ is established. This correspondence relation is maintained irrespective of a state of the operation amount (spool stroke S). Even under the speed reducing control, the pump supply flow rate $Q_L$ at a time of low idling rotation increases along with an increase in the lever operation amount, and the operating speed of the actuator also increases.

The structure of the controller 50 shown in FIG. 4 will now be described in detail.

As shown in FIG. 4, the controller 50 includes the storage unit 51 and a calculation unit 52. The storage unit 51 stores therein a control output value map M1 (FIG. 5(*a*)) showing a correlation of the first control output value C1 with the target engine rotation number N. The calculation unit 52 includes a load-sensing calculation unit 53. To this load-sensing calculation unit 53, the target engine rotation number N detected by a target engine rotation number detection unit S1 is input. Then, in the load-sensing calculation unit 53, the target engine rotation number N is applied to the control output value map M1 to determine the first control output value C1.

The calculation unit 52 further includes an engine speed-sensing calculation unit 54. This is a PID control unit, and determines whether or not the actual engine rotation number is below a reference engine rotation number corresponding to the target engine rotation number N. When the actual engine rotation number is detected as to be lower than the reference rotation number, the PID control unit calculates a second control output value C2. The second control output value C2 is combined with the first control output value C1 calculated by the load-sensing calculation unit 53 to calculate a third control output value C3. Then a command current Ce corresponding to the third control output value C3 is applied to the solenoid 8*a* of the pump control proportional valve 8. This way, the ejection flow rate $Q_P$ of the hydraulic pump 1 is lowered to avoid an engine stall, and the actual engine rotation number is matched with the reference engine rotation number. It should be noted that a map of the reference engine rotation number corresponding to the target engine rotation number N may be stored in the storage unit 51, and the engine speed-sensing calculation unit 54 may calculate the second control output value C2 based on the reference engine speed determined based on this map.

As described above, in the calculation unit 52 of the controller 50, the first control output value C1 calculated by the load-sensing calculation unit 53 and the second control output value C2 calculated by the engine speed-sensing calculation unit 54 are combined together by an adder 55 to generate the third control output value C3. Further, in the controller 50, when an external controller 60 inputs a later described correction rate R to the controller 50, the third control output value C3 is multiplied by this correction rate R to calculate the value of the command current Ce in a correction circuit 56. The command current Ce thus determined is applied to the solenoid 8*a* of the pump control proportional valve 8.

It should be noted that the control pressure $P_C$ for the pump control proportional valve 8 is non-linear with respect to the command current Ce generated by correcting the third control output value C3. Therefore, the third control output value C3 prior to being input to the correction circuit 56 may be corrected by using a linearizing map (not shown in FIG. 4) so that the command current Ce and the control pressure $P_C$ output from the controller 50 is substantially linear.

The correction rate R input from the external controller 60 is calculated by the external controller 60 for correcting the above-described third control output value C3 or the third control output value C3 corrected through the linearizing map (the "third control output value C3" shall hereinafter encompass a value corrected through the linearizing map), when an operation error of the hydraulic actuator is detected in the revolving excavator work machine 10 having the load-sensing type pump control system 5. Therefore, the above calculation by the correction circuit 56 is mainly performed only in limited occasions and situations such as when an error is found in a test performed during a work of the revolving excavator work machine 10 for the first time. It is usually a command current Ce corresponding to the third control output value C3 as it is, which is input to the solenoid 8*a*.

As described, the command current Ce ultimately determined is calculated based on the third control output value C3 which is the sum of the first control output value C1 resulting from the calculation in the load-sensing calculation unit 53 and the second control output value C2 resulting from the calculation in the engine speed-sensing calculation unit 54. The correction rate R determined by the external controller 60 is used for multiplying the third control output value C3 in the controller 50 to calculate the value of the ultimate command current Ce.

As described later, the revolving excavator work machine 10 adopts the load-sensing type pump control system 5. Therefore, an error in the secondary pressure of the pump control proportional valve 8 with respect to the current is combined with an error of the spring 7*a* of the load-sensing valve 7 on which the target differential pressure ΔP, and causes an increased individual difference in the ejection flow rate $Q_P$ of revolving excavator work machine 10 (variation in the pump control accuracy of the individual revolving excavator work machine 10). When an error in the size of the spool of the direction control valve is combined, the individual difference in the driving speed of the hydraulic actuator (variation in the control accuracy of the driving speed of individual revolving excavator work machine 10 in relation to the hydraulic actuator) is also increased. In consideration of the problems, the correction rate R is determined.

Since a variation in an individual difference specific to the load-sensing type pump control system 5 affects the first control output value C1 for "speed reducing control" which is calculated by the load-sensing calculation unit 53, it is conceivable to multiply the first control output value C1 by the correction rate R.

However, in the revolving excavator work machine 10 of this example, the engine speed-sensing calculation unit 54 serving as the above-described PID control unit is built into the controller 50 of the load-sensing type pump control system 5. Therefore, the above-described individual difference also affects the second control output value C2 calculated by the engine speed-sensing calculation unit 54.

In a state where: a decrease that causes the actual engine rotation number to be lower than the reference engine rotation number is detected; the engine speed-sensing calculation unit 54 calculates the second control output value C2; and the pump control proportional valve 8 is controlled based on the third control output value C3 which is the sum of the second control output value C2 and the first control output value C1, if the error in the secondary pressure of the pump control proportional valve 8 with respect to the current is on the lower pressure side of the designed value, the target differential pressure ΔP of the load-sensing type pump control system 5 is not lowered to the designed value, the ejection flow rate $Q_P$ of the hydraulic pump 1 is not lowered very much, and the driving speed of the hydraulic actuator is not sufficiently slowed. That is, the effect of the pump control (hereinafter, "engine speed-sensing control") which involves calculation of the second control output value C2 in the engine speed-sensing calculation unit 54 is not sufficient, and an amount of decrease in the rotation of the engine E equals to or larger than the design.

Further, in the above-described state where a decrease in the engine rotation number is detected and the engine speed-sensing calculation unit 54 calculates the second control output value C2, if the error in the secondary pressure of the pump control proportional valve 8 with respect to the current is on the high pressure side of the designed value, the target differential pressure of the load-sensing type pump control system 5 decreases more than the designed value, the ejection flow rate $Q_P$ of the hydraulic pump 1 is reduced more than necessary, and the traveling speed of the revolving excavator work machine 10 and the driving speed of the hydraulic actuator becomes too slow. That is, the effect of the engine speed-sensing control is excessively high, and there is a concern for hunting of the engine E.

That is, since the variation in the effect by the above-described "speed reducing control" is reduced and the variation in the effect of the engine speed-sensing control caused by an individual difference in the secondary pressure of the pump control proportional valve 8 with respect to the current is also reduced, the third control output value C3 which is the sum of the first control output value C1 for the "speed reducing control" and the second control output value C2 for the engine speed-sensing control is corrected. By multiplying the third control output value C3 by the correction rate R, the command current Ce to be applied to the solenoid 8*a* of the pump control proportional valve 8 is determined.

Not only can this structure reduce the variation in the effect of the speed reducing control that appears in the form of variation in the driving speed of the hydraulic actuator of the revolving excavator work machines 10, but the configuration can also even out the variation in the effect of the engine speed-sensing control that occurs in the form of variation in the behavior of the engine.

Figure 8:
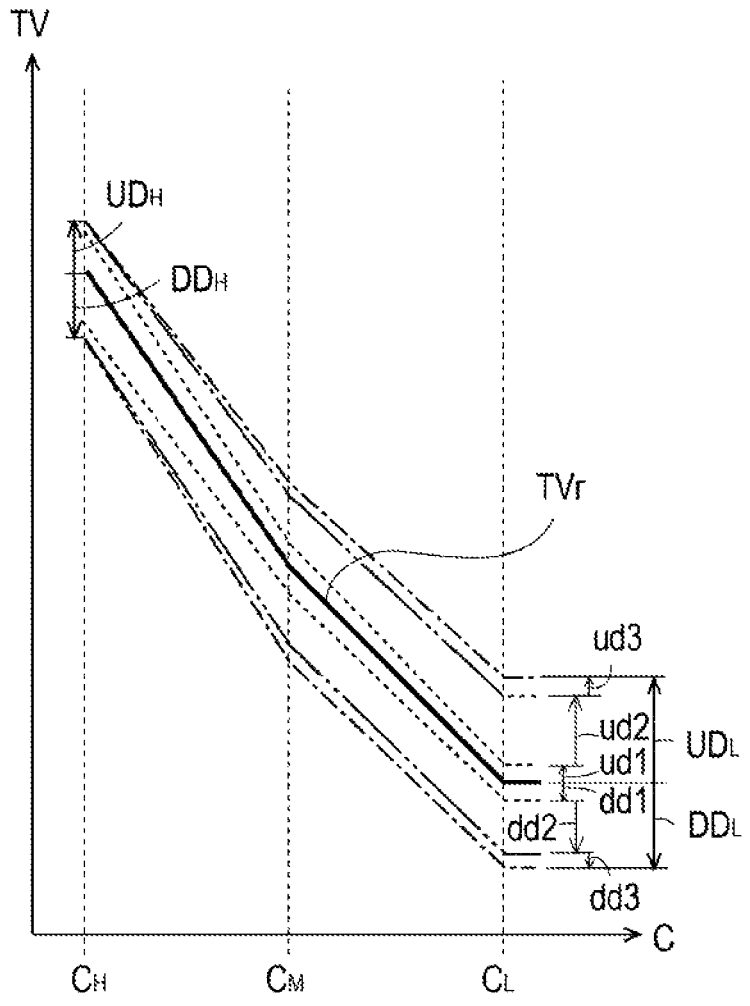
FIG. 8 A graph showing a distortion width of the traveling speed relative to the target engine rotation number under control by the load-sensing type pump control system.
Figure 9:
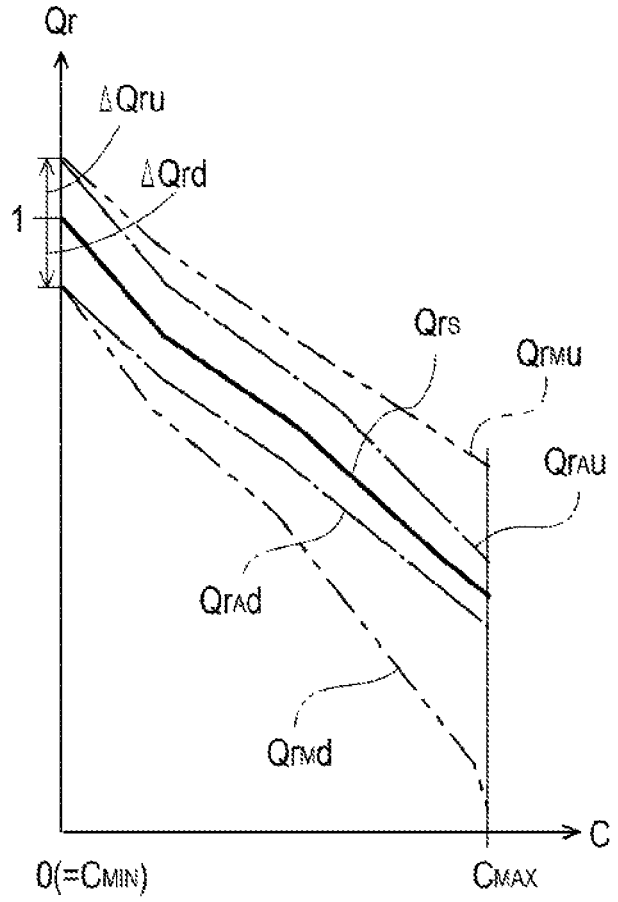
FIG. 9 A graph showing a correction effect of the pump ejection flow rate in an example.

With reference to FIG. 8 and FIG. 9, the following describes the error that could occur in the speed control of the hydraulic actuator using the load-sensing type pump control system 5.

The following describes errors found in the driving speeds of traveling motors 23, 24 in cases where a control pressure $P_C$ of a certain value is applied to the load-sensing valve 7 so that the control the ejection flow rate $Q_P$ of the hydraulic pump 1 is controlled to be a certain value. Further, the wording "control output value C" in the following description corresponds to the third control output value C3 described hereinabove. More specifically, the wording corresponds to the first control output value C1 determined by the load-sensing calculation unit 53 based on the control output value map M1, in cases where the actual engine rotation number does not drop below the reference engine rotation number. On the other hand, the wording corresponds to the sum of the first control output value C1 and the second control output value C2 calculated by the engine speed-sensing calculation unit 54, in cases of detecting such a decrease in the actual engine rotation number.

FIG. 8 shows the characteristics in relation to the control output value C for the traveling speed of the revolving excavator work machine 10 obtained by driving the travel motors 23, 24. The graph TVr shows a designed traveling speed characteristic. The following description assumes that the traveling operation levers 33*a*, 34*a* are operated by their maximum operation amounts. Regarding the control output value C, $C_H$ is a control output value at a time of high idling rotation, $C_L$ is a control output value at a time of low idling rotation, and $C_M$ is a control output value while the engine is driven at an intermediate rotation number between the high idling rotation number and the low idling rotation number (hereinafter, referred to as "at a time of intermediate speed rotation").

The control output value $C_H$ at a time of high idling rotation is a value that does not generate the control pressure $P_C$, that is, a minimum value of the control output value C. At a time of low idling rotation, the control output value $C_L$ is applied to the pump control proportional valve 8 to generate the control pressure $P_C$, so as to reduce the inclination angle of the movable swash plate 1*a* even while the movable swash plate 1*a* is far from the maximum inclination angle, and to reduce the ejection flow rate $Q_P$ to bring the traveling speed TV to a low speed.

The control output value $C_M$ at a time of intermediate speed rotation is a value between the control output value $C_H$ at a time of high idling rotation and a low idling rotation $C_L$ at a time of low idling rotation. At this time, the rotational speeds of the traveling motors 23, 24 are the intermediate speed between the rotational speed at the time of high idle rotation and the rotational speed at the time of low idle rotation. The traveling speed TV of the revolving excavator work machine 10 with the maximum operation amounts of the traveling operation levers 33*a*, 34*a* is lower than the traveling speed TV at a time of high idling rotation but higher than the traveling speed TV at a time of high idling rotation.

In this embodiment, the target value of the supply/required flow rate ratio of each of the traveling motors 23, 24 at a time of intermediate speed rotation is achieved when the movable swash plate 1*a* is arranged at a smaller inclination angle than the maximum inclination angle. The rotational speeds of the traveling motors 23, 24 become the intermediate speed by driving the hydraulic pump 1 with the movable swash plate 1*a* arranged at an inclination angle between the inclination angle at the time of high idling rotation and the inclination angle at a time of low idling rotation.

On the other hand, FIG. 9 shows a relationship between the control output value C and the flow rate ratio Qr to each of the traveling motors 23 and 24, and shows a characteristic of a designed supply flow rate ratio in a graph $Qr_S$. The flow rate ratio Qr is a flow rate ratio when the operation amounts of the traveling operation levers 33*a*, 34*a* are maximized and the control output value C is 0, and where the maximum value of the designed flow rate ratio $Qr_S$ to each of the traveling motors 23, 24 is 1.

FIG. 8 shows the ratio of a maximum error in the travel speed TV within a tolerance range based on the error factors in driving the traveling motors 23, 24, with respect to the designed traveling speed TVr (hereinafter, "maximum error ratio").

First, to the traveling motors 23, 24, pressure oil is supplied through meter-in throttles of the direction control valves 33, 34, respectively, as shown in FIG. 2. Therefore, an error may take place in the opening degrees (opening areas) of these meter-in throttles. If variation occurs in the relation of the opening degrees of the meter-in throttles with respect to the traveling operation levers 33*a*, 34*a* due to the error, the error will result in individual differences in the supply flow rates to the traveling motors 23, 24, and result in an individual difference in the traveling speed TV of the revolving excavator work machines 10.

In FIG. 8, the maximum error ratio, on a speed-acceleration side (pump ejection flow rate increase side), of the traveling speed TV attributed to the error in the opening degree (opening area of opening) of the meter-in throttles of the direction control valves 33, 34 is expressed as "ud1", whereas the maximum error ratio, on a speed-deceleration side (pump ejection flow rate decrease side) is expressed as "dd1".

Suppose the ejection flow rate $Q_P$ is reduced due to the function of the load-sensing valve 7, to a value smaller than the maximum value of the ejection flow rate of the hydraulic pump 1 while the movable swash plate 1*a* is at its maximum inclination angle $\Theta_{MAX}$. In this case, if there is an error in the structure of the spring 7*a* of the load-sensing valve 7, the error will result in a setting error of the target differential pressure ΔP, which leads to an increase/decrease of the ejection flow rate $Q_P$. If there is an error in the traveling motors 23, 24, the influence therefrom will result in an increase/decrease of the traveling speed TV.

In FIG. 8, the maximum error ratio on the speed-acceleration side (pump ejection flow rate increase side) in the traveling speed TV attributed to an error in the target differential pressure ΔP at the load-sensing valve 7 is expressed as "ud2", the maximum error ratio on the speed-deceleration side (pump ejection flow rate decrease side) is expressed as "dd2".

That is, in terms of traveling speed TV in FIG. 8, the traveling speed TV fluctuates within a range up to the maximum error ratio of "ud1" on the speed-acceleration side, and fluctuates within a range down to the maximum error ratio "dd1" on the speed-deceleration side, when an opening degree of the meter-in throttle is within its tolerance. However, if an increase/decrease within the tolerance of the differential pressure setting (tolerance in the performance of the spring 7*a*) of the load-sensing valve 7 is combined, the traveling speed TV will fluctuate within a range from the designed traveling speed Tvr up to the maximum error ratio of ud1+ud2 on the speed-acceleration side, and fluctuates within a range from the designed traveling speed Tvr down to the maximum error ratio of dd1+dd2 on the speed-deceleration side.

Thus, regarding the designed flow rate ratio $Qr_S$ while the control output value C is 0, there will be fluctuation within a range from the designed flow rate ratio of 1 to ΔQru at the most on the increasing side and fluctuation within a range from the designed flow rate ratio of 1 to ΔQrd at the most on the decreasing side as shown in FIG. 9, when the maximum error within a tolerance range of the opening degree of the meter-in throttles of the direction control valves 33, 34 is combined with the maximum error within the tolerance range of the target differential pressure (spring 7*a*) in the load-sensing valve 7.

Further, while the control pressure $P_C$ is applied to the load-sensing valve 7, an error may take place in the relationship between the secondary pressure (control pressure $P_C$) of the pump control proportional valve 8 and the command current Ce applied to the solenoid 8*a* (current—secondary pressure characteristic).

In FIG. 8, the maximum error ratio on the speed-acceleration side (pump ejection flow rate increase side) in the traveling speed TV attributed to an error in the current-secondary pressure characteristic of the pump control proportional valve 8 is expressed as "ud3", the maximum error ratio on the speed-deceleration side (pump ejection flow rate decrease side) is expressed as "dd3".

That is, to the maximum error ratio ud1+ud2 on the speed-acceleration side of the designed traveling speed TV, the maximum error ratio ud3 based on the tolerance of the current-secondary pressure characteristic is added. To the maximum error ratio dd1+dd2 on speed-deceleration side of the designed traveling speed TV, the maximum error ratio dd3 based on the tolerance of the current-secondary pressure characteristic is added.

As described, even if the errors in the meter-in throttles of the direction control valves, the differential pressure setting of the load-sensing valve 7 (characteristic in the spring 7*a*), and the current-secondary pressure characteristic of the pump control proportional valve 8 are within their respective tolerances, these errors will be combined and lead to an error in the characteristic in the pump ejection flow rate. As a result, when a plurality of revolving excavator work machines 10 are produced, there will be significantly large variations in the characteristics of the pump ejection flow rates of the load-sensing type pump control among the products. Such variations will appear in the form of variations in the traveling speed TV in cases of the traveling motors 23, 24.

In FIG. 8, when the three error factors are combined, the maximum error ratio on the speed-acceleration side from the designed traveling speed TVr at a time of a given engine rotation number is expressed as UD, and the maximum error ratio on the speed-deceleration side is expressed as DD. More specifically the maximum error ratio on the speed-acceleration side from the designed traveling speed TV at a time of the high idling rotation is expressed as $UD_H$, and the maximum error ratio on the speed-deceleration side is expressed as $DD_H$. On the other hand, the maximum error ratio on the speed-acceleration side from the designed traveling speed TV at a time of the low idling rotation is expressed as $UD_L$, and the maximum error ratio on the speed-deceleration side is expressed as $DD_L$.

The following describes: the maximum error ratios ud2 and dd2 of the traveling speed TV attributed to the error in the target differential pressure ΔP based on the tolerance of the spring 7*a* of the load-sensing valve 7; and the maximum error ratios ud3 and dd3 of the traveling speed TV based on the tolerance of the current-secondary pressure characteristic of the pump control proportional valve 8.

First, the decrease in the traveling speed TV shown in FIG. 8 is attributed to a decrease in the target differential pressure ΔP due to an increase in the control output value C and the control pressure $P_C$. That is, the designed traveling speed TVr which serves as the denominator of the maximum error ratios ud2, dd2, ud3, dd3 of the traveling speed TV decreases with a decrease in the target differential pressure ΔP due to an increase in the control pressure $P_C$.

On the other hand, it is an error in the specified differential pressure $\Delta P_0$ that causes the error in the traveling speed which is a numerator of each of the maximum error ratios ud2, dd2 based on the tolerance of the spring 7*a* of the load-sensing valve 7, and the error value is constant irrespective of variation in the control pressure $P_C$ and the target differential pressure ΔP. Therefore, the maximum error ratios ud2, dd2 of the traveling speed TV increases with a decrease in the set traveling speed TVr which is a denominator, and is minimized at a time of high idling rotation (when the control pressure $P_C$ is minimum), and maximized at a time of low idling rotation (when the control pressure $P_C$ is maximum).

Further, it is an error in the control pressure $P_C$ that causes an error in the traveling speed which is the numerator of each of the maximum error ratios ud3, dd3 of the traveling speed TV based on the current-secondary pressure characteristic of the pump control proportional valve 8, and the error value increases with an increase in the control pressure $P_C$, that is, with a decrease in the traveling speed TV. Therefore, with a decrease in the setting traveling speed TVr which is the denominator, the error value of the numerator increases, and the maximum error ratios ud3, dd3 of the traveling speed TV increase. The error is minimum at a time of high idling rotation (when the control pressure $P_C$ is minimum), and is maximum at a time of low idling rotation (when the control pressure $P_C$ is maximum).

On the other hand, when the meter-in throttles of the direction control valves 33, 34 are fixed at the maximum opening degree, the maximum error ratios ud1, dd1 attributed to the tolerance of the meter-in throttles are not relevant to the specified differential pressure $\Delta P_0$, nor is it relevant to the control output value C and the control pressure PC. The maximum error ratios ud1, dd1 are constant regardless of changes in the designed traveling speed TVr caused by variation in the control output value C. Therefore, in FIG. 8, an increase in the designed traveling speed TVr as the denominator causes broader fluctuation from the designed traveling speed TVr, on the graph showing the maximum error ratios ud1, dd1.

Therefore, in terms of the maximum error ratios UD, DD in which the three error factors are combined, the maximum error ratios each increases with a decrease in the designed traveling speed TVr.

As a result, the maximum error ratios $UD_L$, $DD_L$ in the traveling speed TV at a time of low idling rotation with respect to the designed traveling speed TVr are larger than the maximum error ratios $UD_H$, $DD_H$ in the traveling speed TV at a time of high idling rotation with respect to the designed traveling speed TVr. For example, the maximum error ratios $UD_L$, $DD_L$ in the traveling speed TV at a time of low idling rotation is thought to be approximately a double the maximum error ratios $UD_H$, $DD_H$ of the traveling speed TV at a time of high idling rotation.

In a characteristic graphs $Qr_M u$, $Qr_M d$ of FIG. 9 showing the flow rate ratio Qr with respect to the control output value C, the maximum fluctuation ranges from the designed flow rate ratio $Qr_S$, caused by the tolerances of the above three factors (i.e., the meter-in throttles of the direction control valves 33, 34, the negative pressure setting of the load-sensing valve 7, the current-secondary pressure characteristic of the pump control proportional valve 8) are shown. The graph $Qr_M u$ shows the characteristic of the flow rate ratio in a state where the flow rate ratio fluctuates by the maximum amount toward the increasing side. The graph $Qr_M d$ shows the characteristic of the flow rate ratio in a state where the flow rate ratio fluctuates by the maximum amount toward the decreasing side.

As is seen from the graph, while the fluctuation ranges from the designed flow rate ratio when the control output value C is 0 (minimum value $C_{MIN}$) are ΔQru, ΔQrd, the range of fluctuation broadens with an increase in the control output value C. The amount of each of the fluctuation ranges ΔQru, ΔQrd broadened from the initial state is attributed to the above-described tolerances related to the load-sensing valve 7 and the pump control proportional valve 8.

To observe an error in relation to the pump control accuracy of an individual revolving excavator work machine 10, it is conceivable to: store a supply flow rate or its substitute numerical value to the hydraulic actuator for driving a hydraulic actuator; actually drive the hydraulic actuator to measure the supply flow rate or its substitute numerical value to the hydraulic actuator; calculate a correction rate (correction coefficient) of the control output value C based on the designed value and the measured value; and correct the control output value C by using the correction rate.

By setting the control output value C to its maximum value $C_{MAX}$ and the control pressure $P_C$ to its maximum value, the errors in the spring 7*a* (setting of the target differential pressure ΔP) of the load-sensing valve 7 and the current-secondary pressure characteristic of the pump control proportional valve 8 most conspicuously appear in the supply flow rate to the hydraulic actuator. Therefore, to determine the correction rate to cancel the effect of the errors related to the load-sensing valve 7 and the pump control proportional valve 8, it is most suitable to determine the correction rate based on the fluctuation range of the flow rate ratio Qr from the designed flow rate ratio $Qr_S$ when the flow rate ratio Qr shown in FIG. 9 is at its minimum value or its nearby value, and when the control output value C is at its maximum value $C_{MAX}$ or its nearby value.

The graphs $Qr_Au$, $Qr_Ad$ of FIG. 9 show, at what state of the control output value C, the correction coefficient should be determined in order to highly effectively cancel the fluctuation attributed to the errors in the load-sensing valve 7 and the pump control proportional valve 8. The difference between $Qr_Au$ and $Qr_Mu$ indicates how effectively the fluctuation on the flow rate ratio increasing side is canceled, whereas the difference between $Qr_Ad$ and $Qr_Md$ indicates how effectively the fluctuation in the flow rate ratio decreasing side is canceled.

When the control output value C is 0 (minimum $C_{MIN}$), the difference between $Qr_Au$ and $Qr_Mu$, and the difference between $Qr_Ad$ and $Qr_Md$ are each 0. This indicates that: the effects of errors related to the load-sensing valve 7 and the pump control proportional valve 8 hardly appear on the flow rate ratio (or the effects are the minimum); and therefore, the correction rate determined when the control output value C is 0 brings about 0 (or extremely small) effect of canceling the errors.

While the flow rate ratio Qr decreases with an increase in the control output value C, the effects of the errors related to the load-sensing valve 7 and the pump control proportional valve 8 start to appear, and the effect of correction increases. When the control output value C is the maximum value $C_{MAX}$ and the flow rate ratio Qr becomes the minimum value, the difference between the $Qr_Au$ and $Qr_Mu$ and the difference between $Qr_Ad$ and $Qr_Md$ are maximized. The $Qr_Au$ and $Qr_Ad$ each indicating the corrected flow rate ratio becomes closest to the designed flow rate ratio $Qr_S$.

As should be understood from the above, by determining the correction rate based on a measured value measured when the control output value C is its maximum value $C_{MAX}$ or its nearby value and the flow rate ratio Qr is its minimum value or its nearby value, the effects of the errors related to the load-sensing valve 7 and the pump control proportional valve 8 are most effectively canceled.

To measure the actual supply flow rate to the hydraulic actuator, means such as a flowmeter is necessary. This, however, makes the method of measurement complex. Therefore, it is preferable to measure an easily-measurable numerical value that substitutes for the actual supply flow rate to the hydraulic actuator. In cases of traveling motors 23, 24, it is conceivable to measure the rotation number of the drive sprocket 11*b* as the numerical value substituting for the supply flow rate to the traveling motors 23, 24.

Figure 10:
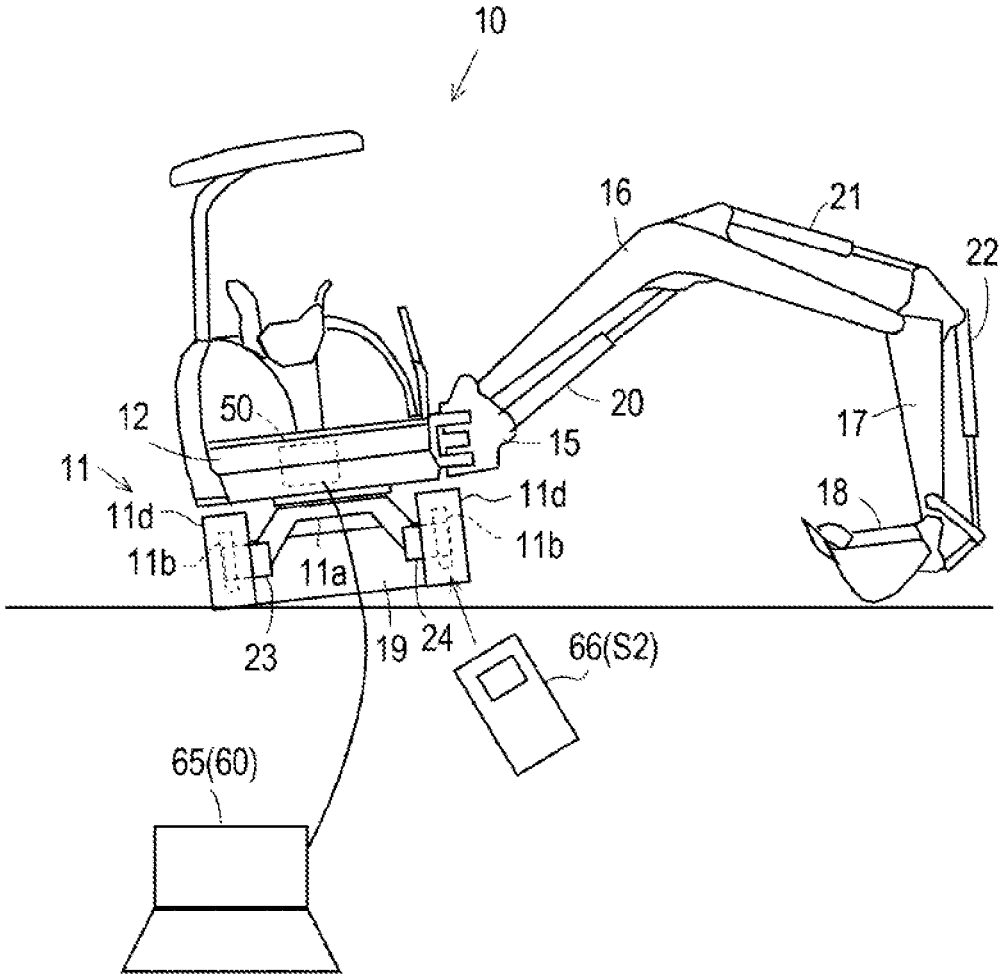
FIG. 10 A schematic diagram of a revolving excavator work machine showing a measurement of a supply flow rate to a traveling motor based on a detected rotation number of a drive sprocket of the revolving excavator work machine.

FIG. 10 shows a process of determining the correction rate based on a measured rotation number of the drive sprocket 11*b* substituting for the actual supply flow rate to one of the traveling motors 23, 24. First, the boom 16, the arm 17, the bucket 18 are oriented perpendicular to the direction of the crawlers 11*d* in plan view (as should be imagined with reference to FIG. 10 and the like, although FIG. 10 is not a plan view). The bucket 18 is grounded, and the hydraulic pump 1 is driven to bring the boom 16 and the arm 17 closer to the revolving pedestal 12. This lifts the crawler 11*d* closer to the bucket 18, while the crawler 11*d* far from the bucket 18 is kept grounded. This way, the crawler 11*d* closer to the bucket 18, and the drive sprocket 11*b* and the driven sprocket 11*c* around which the crawler 11*d* is wound are jacked up.

Then, by supplying oil ejected from the hydraulic pump 1 to drive the traveling motor 23 or the traveling motor 24 serving as the hydraulic actuator for driving the drive sprocket 11*b* jacked up (the following description supposes that the motor is the traveling motor 24, as shown in FIG. 10), the drive sprocket 11*b*, the crawler 11*d* lifted from the ground, and the driven sprocket 11*c* to which the crawler 11*d* is wound run idle, and the rotational speed can be measured.

The second travel operation lever 34*a* is operated by its maximum operation amount (i.e., setting speed is maximum) so that the traveling motor 24 rotates at its maximum speed. Meanwhile, the engine E is driven at the low idling rotation number, the maximum control output value C is generated and the ejection flow rate $Q_P$ is kept at its minimum value. At this time, the rotational speed of the drive sprocket 11*b* substituting for the supply flow rate to the traveling motor 24 stays low. Thus, the rotation number of the drive sprocket 11*b* at this time is measured by using a portable rotation number measurement device 66.

A portable (e.g., tablet type) personal computer (PC) 65 separate from the revolving excavator work machine 10, i.e., provided outside the revolving excavator work machines 10 is connected through a cable and the like to the controller 50 of the revolving excavator work machine 10. In the storage unit of this PC, a minimum value of the rotational speed of the drive sprocket 11*b*, at a time of low idling rotation when the second travel operation lever 34*a* is operated by its maximum amount, i.e., the designed value of the rotational speed of the drive sprocket 11*b*, when the ejection flow rate is minimized by adding the control pressure $P_C$.

After the measurement of the actual rotation number of the drive sprocket 11*b*, a signal indicating the actual rotation number of the drive sprocket 11*b* detected by the rotation number measurement device 66 is input through a USB connection and the like. In the calculation unit of the PC 65, the correction rate is calculated based on the difference between the actual rotation number and the designed rotation number.

The above steps are described with reference to the block diagram of FIG. 4. While the controller 50 is provided in the revolving excavator work machine 10, the external controller 60 is provided outside of the revolving excavator work machine 10. The PC 65 shown in FIG. 10 is an example of the external controller 60.

A storage unit 61 of the external controller 60 stores therein a designed numerical value (target value) substituting for the supply flow rate to the hydraulic actuator subjected to the measurement, when the operation amount of the hydraulic actuator is maximized and the pump ejection flow rate is minimized (when the control output value is maximum). This value in the example shown in FIG. 10 is a designed rotation number MNs of the drive sprocket 11*b* assuming that the operation amount of the second travel operation lever 34*a* is maximum, and the pump ejection flow rate is minimized by driving the engine E at the low idling rotation number.

It should be noted that, when the measurement subject is the boom cylinder 20 or the revolving motor 25 exemplified in the description regarding generation of the control output value, the target value of the substitute numerical value to be stored in the storage unit 61 is a numerical value substituting for the target supply flow rate to the hydraulic actuator which is derived from the graph shown in FIG. 6, although FIG. 6 illustrates a correlation of the ejection flow rate $Q_P$ of the hydraulic pump 1 to the target engine rotation number N when the operation amounts of the levers 30*a*, 35*a* are maximum.

Therefore, for example, the storage unit 61 stores, for each hydraulic actuator, a map as shown in FIG. 6 of the target supply flow rate corresponding to variation in the engine rotation number. When a corresponding hydraulic actuator is subjected to measurement, the engine rotation number and the operation amount are applied to this map as the measurement conditions to determine the value of the designed supply flow rate. Then, the substitute designed numerical value corresponding to the designed supply oil flow rate value thus determined may be determined.

Atypical conceivable numerical value substituting for the designed supply oil flow rate value is the driving speed of the hydraulic actuator to be subjected to driving. In the above-described embodiment, such a conceivable substitute numerical value is the rotation number of the drive sprocket 11*b* to be driven by the traveling motor 24. In the case of boom cylinder 20, a conceivable substitute numerical value is the rotation number of the boom 16 about a pivot shaft of the boom 16 in the boom bracket 15. If there is any other numerical value that can be easily measured by the measured value detection unit S2 shown in FIG. 4, that numerical value may be used.

Further, if an oil meter configured to measure the ejection flow rate of the hydraulic pump 1 can be used as the measured value detection unit S2, it is conceivable to store the designed supply oil flow rate value itself in the storage unit 61, instead of using the substitute numerical value described hereinabove.

To the external controller 60, an input signal indicating a numerical value detected by the measured value detection unit S2 is input, the measured value detection unit S2 configured to detect a numerical value substituting for the actual supply flow rate to the hydraulic actuator. In the example shown in FIG. 10, the measured value detection unit S2 is the rotation number measurement device 66, and the measured rotation number MNr from the drive sprocket 11*b* is input to the external controller 60.

In a calculation unit 62 in the external controller 60 (PC 65), the designed value (e.g., the designed rotation number MNs of the drive sprocket) stored in the storage unit 61 and a measured value (e.g. a measured rotation number MNr of the drive sprocket) from the measured value detection unit S2 are compared, and the correction rate R for the control output value is calculated (determined) based on the comparison (difference). That is, the ratio of the control output value C for correcting the measured value so it equals to the designed value is calculated.

It should be noted that after the crawler 11*d* on one side out of the left and right is jacked up to measure the rotation number of the drive sprocket 11*b* driven by one of the traveling motors 24, the position of the boom 16, the arm 17, and the bucket 18 with respect to the left and right crawlers 11*d* may be changed, and the crawler 11*d* on the opposite side may be jacked up. Then the first traveling operation lever 33*a* may be operated by its maximum operation amount to drive the engine at the low idling rotation number. Then, the rotation number of the drive sprocket 11*b* driven by the other traveling motor 23 may be measured. The measured rotation numbers of both left and right drive sprockets 11*b* are compared with the designed rotation number, to calculate the correction rate R for the control output value C.

Then, in the example of FIG. 10 for example, the PC 65 is brought onboard the revolving excavator work machines 10 and connected to a USB port and the like provided in the revolving excavator work machine 10, and the correction rate R thus determined is input to the controller 50 and stored in the storage unit 51 (see FIG. 4) of the controller 50. This corresponds to an input of the correction rate R from the external controller 60 to the controller 50, as hereinabove described.

By performing the above steps of correcting the control output value with respect to individual revolving excavator work machines 10 before shipment, the variation in the pump control accuracy can be reduced among the plurality of revolving excavator work machines 10 scheduled to be shipped.

FIG. 9 shows a state where the traveling operation levers 33*a*, 34*a* are each operated by the maximum operation amount, and the differences between the designed flow rate ratio $Qr_S$ and the flow rate ratios $Qr_M u$, $Qr_M d$ at a time of maximum fluctuation contain fluctuations of ΔQru, ΔQrd attributed to the tolerance of the meter-in throttles of the direction control valves 33, 34, irrespective of how much control output value C being applied. Therefore, in a case of determining the correction rate based on the measured rotation number of the drive sprocket 11*b* in a state where the flow rate ratio Qr approximates the minimum value, the correction rate does cancel the fluctuations ΔQru, ΔQrd attributed to tolerance of the meter-in throttles of the direction control valves 33, 34.

However, it is unknown how much effect to the supply flow rate of the traveling motors 23, 24 is attributed to the errors in the meter-in throttles of the direction control valves 33, 34. To find this out, a conceivable approach is to: measure the rotation number of the drive sprocket 11*b* at a time of high idling rotation where the control output value C is 0 (minimum value $C_{MIN}$), and with a maximum operation amount of the traveling operation levers 33*a*, 34*a* so that the error in the meter-in throttles affect the most; and then calculate the correction rate by comparing the measured value with the designed value. It is also possible to measure the rotation number of the drive sprocket 11*b* while the control output value is near the minimum value $C_{MIN}$, and calculate the correction rate.

This measurement of the rotation number at a time of high idling rotation may be performed along with measurement of the rotation number of the drive sprocket at a time of low idling rotation, with the revolving excavator work machine 10 being jacked up as shown in FIG. 10. Alternatively, after the control output value C is corrected based on the rotation number measured at a time of low idling rotation shown in FIG. 10, the revolving excavator work machine 10 may actually run to measure the rotation number of the drive sprocket 11*b*, and then correct the correction rate once determined in the process of FIG. 10.

Regarding the expansion/contraction type hydraulic actuator, namely, for each of the boom cylinder 20, the arm cylinder 21, the bucket cylinder 22, the swing cylinder, and the blade cylinder, a numerical value substituting for the actual supply flow rate to the corresponding hydraulic actuator can be measured by detecting an amount of expansion/contraction of the hydraulic actuator.

Of the hydraulic actuators in the revolving excavator work machine 10, the rotation type hydraulic actuators, namely, the drive sprockets 11*b* and the revolving pedestal 12 which are driven by the traveling motors 23, 24 and the revolving motor 25, as well as the expansion/contraction type hydraulic actuators, namely, regarding the boom cylinder 20, the arm cylinder 21, the bucket cylinder 22, the swing cylinder, and the blade cylinder expand or contract to rotate the boom 16, the arm 17, the bucket 18, the boom bracket 15, and blades (earth removal plates) 19 are driving targets. Therefore, a numerical value substituting for the actual supply flow rate to the corresponding hydraulic actuator can also be measured by detecting the rotation speed of the driving target.

Further, if there is a large error between the meter-in throttle of the direction control valve 33 and the meter-in throttle of the direction control valve 34, the error may cause a problem in a straight traveling of the revolving excavator work machine 10. In view of this, the rotation numbers of both left and right drive sprockets 11*b* may be measured. At a time of calculating the correction rate of the control output value C after the differences between each of the measured rotation numbers and the designed rotation number are measured, the correction rate may be calculated considering restriction of the traveling speed to a speed that does not cause such a problem in straight traveling.

As hereinabove described, a revolving excavator work machine 10 includes a plurality of hydraulic actuators (boom cylinder 20, arm cylinder 21, traveling motors 23, 24, revolving motor 25, and the like) that are driven by oil ejected from a variable displacement type hydraulic pump 1 driven by an engine E. A load-sensing type pump control system 5 having a controller 50 and an external controller 60 is configured to control an ejection flow rate $Q_P$ of oil ejected from the hydraulic pump 1 to achieve a target differential pressure ΔP which is a target value of a differential pressure between an ejection pressure $P_P$ of oil ejected from the hydraulic pump 1 and a maximum load pressure $P_L$ of oil supplied to the hydraulic actuators.

The load-sensing type pump control system 5 generates the control pressure $P_C$ for changing the target differential pressure ΔP, as the secondary pressure of the pump control proportional valve 8 which is an electromagnetic proportional valve. The controller 50 in the revolving excavator work machine 10 includes a calculation unit 52 and a target engine rotation number detection unit S1. The external controller 60 (PC 65 and the like) in the exterior of the revolving excavator work machine 10 includes: a storage unit 61, a calculation unit 62, and a measured value detection unit S2 (rotation number measurement device 66 and the like) configured to detect an actual supply oil flow rate (flow rate ratio Qr) of at least one of the hydraulic actuators (traveling motor 24 in the above-described embodiment) or its substitute numerical value (an actual rotation number MNr of the drive sprocket 11*b* driven by the traveling motor 24 in the above-described embodiment).

The load-sensing type pump control system 5 is configured such that: the calculation unit 52 of the controller 50 in the revolving excavator work machine 10 calculates a control output value C serving as a source for a command current Ce to be applied to the pump control proportional valve 8, according to the target engine rotation number N detected by the target engine rotation number detection unit S1.

The storage unit 61 of the external controller 60 stores, for the at least one of the hydraulic actuators (traveling motor 24), a designed supply oil flow rate value (designed flow rate ratio $Qr_S$) or its substitute numerical value (designed rotation number MNs) in a specific drive state for the at least one of the hydraulic actuators (traveling motor 24), the specific drive state being a state assumed when the at least one of the hydraulic actuators is driven with a specific engine rotation number N and a specific manual operation amount. The calculation unit 62 of the external controller 60 calculates a correction coefficient (correction rate R) for the control output value C, by comparing the actual supply oil flow rate (flow rate ratio Qr) or its substitute numerical value (an actual rotation number MNr of the drive sprocket 11*b* driven by the traveling motor 24) detected by the measured value detection unit S2 (rotation number measurement device 66 and the like) when the at least one of the hydraulic actuators (traveling motor 24) is actually driven in the specific drive state, with the designed supply oil flow rate value (designed flow rate ratio $Qr_S$) or its substitute numerical value (designed rotation number MNs) stored in the storage unit 61. The load-sensing type pump control system 5 is such that the control output value C calculated by the calculation unit 52 of the controller 50 is corrected with the correction coefficient (correction rate R) calculated by the calculation unit 62 of the external controller 60.

With the configuration as described above, a work for reducing variation in the operating performance of the hydraulic actuator for each hydraulic machine (revolving excavator work machine 10) can be performed by controlling the control pressure in an existing load-sensing type pump control system 5. For example, there is no need for providing the hydraulic machine itself with an additional piece of equipment such as a pressure sensor to monitor the ejection pressure of the hydraulic pump 1. Therefore, the efficiency in a correction work for canceling errors in the product before its shipment or at a time of using the product for the first time can be improved at a low cost.

Further, for example, to correct an error in pump control attributed to a factor such as the load-sensing valve 7 and the pump control proportional valve 8 which affects the control pressure $P_C$ and the control output value C, the specific manual operation amount (operation amount of the lever 34*a*) in the specific drive state is a maximum manual operation amount (maximum value $S_{MAX}$) of the at least one of the hydraulic actuators (traveling motor 24), and the specific engine rotation number (low idling rotation number $N_L$) that yields a maximum control output value C or its nearby value.

That is, performance errors and the like of means for generating a target differential pressure ΔP (a spring 7*a* and the like of a load-sensing valve 7) or (a solenoid 8*a* and the like of) the pump control proportional valve 8 for generating the control pressure $P_C$ used in the load-sensing type pump control system 5 has an influence in the form of errors in the control pressure $P_C$. A device configuration to address errors in the pump ejection flow rate characteristic caused by such a factor is such that the above-described correction is performed by driving the hydraulic pump 1 at an engine rotation number that yields a maximum control pressure $P_C$. This device configuration can further improve the efficiency of correcting such errors in the pump ejection flow rate characteristic.

Further, for example, to correct an error in the operating speed of the hydraulic actuator (traveling motor 24 in the above-described example) attributed to a factor not relevant to the control pressure $P_C$ and the control output value C, such as an error in the meter-in throttle of the direction control valve (direction control valve 34) of the hydraulic actuator (traveling motor 24), the specific manual operation amount (operation amount of the lever 34*a*) in the specific drive state is a maximum manual operation amount (maximum value $S_{MAX}$) of the at least one of the hydraulic actuators (traveling motor 24), and the specific engine rotation number (high idling rotation number $N_H$) that yields a minimum control output value C or its nearby value.

That is, performance errors and the like of (a meter-in throttle and the like of) a direction control valve for each hydraulic actuator has an influence in the form of errors in the operating speed of the hydraulic actuator, apart from the control pressure $P_C$. A device configuration to address errors in the operating speed of the hydraulic actuator due to the above factor is such that the above-described correction is performed by driving the hydraulic pump 1 at an engine rotation number that yields a minimum control pressure $P_C$. This configuration minimizes an influence of the error factor affecting the control pressure $P_C$ to the operating speed of the hydraulic actuator so that an error in the operating speed of the hydraulic actuator caused by a factor irrelevant to the control pressure can be reliably corrected, while being distinguished from the errors in the control pressure.

Further, for example, to correct an error in pump control attributed to a factor such as the load-sensing valve 7 and the pump control proportional valve 8 which affects the control pressure $P_C$ and the control output value C, and correct an error in the operating speed of the hydraulic actuator (traveling motor 24 in the above-described embodiment) attributed to a factor not relevant to the control pressure $P_C$ and the control output value C, such as an error in the meter-in throttle of the direction control valve (direction control valve 34) of the hydraulic actuator (traveling motor 24), the specific drive state includes a first specific drive state and a second specific drive state; the specific manual operation amount (operation amount of the lever 34*a*) in the first specific drive state and the second specific drive state is a maximum manual operation amount (maximum value $S_{MAX}$) of the at least one of the hydraulic actuators (traveling motor 24); the specific engine rotation number N in the first specific drive state is an engine rotation number (low idling rotation number $N_L$) that yields a maximum control output value C or its nearby value; and the specific engine rotation number N in the second specific drive state is an engine rotation number (high idling rotation number $N_H$) that yields a minimum control output value C or its nearby value. The calculation unit 62 of the external controller 60 calculates a correction coefficient (correction rate R) for the control output value C, by comparing the actual supply oil flow rate (flow rate ratio Qr) or its substitute numerical value detected by the measured value detection unit S2 (rotation number measurement device 66 and the like) when the at least one of the hydraulic actuators (traveling motor 24) is actually driven in the first specific drive state and the second specific drive state, with the designed supply oil flow rate value (designed flow rate ratio $Qr_S$) or its substitute numerical value (designed rotation number MNs) stored in the storage unit 61.

Further, the device configuration that performs work as described above can efficiently correct errors in the pump ejection flow rate characteristic caused by factors related to the control pressure and errors in the operating speed characteristic of the individual hydraulic actuator caused by factors irrelevant to the control pressure $P_C$.

The load-sensing type pump control system 5 is configured to control the ejection flow rate $Q_P$ of oil ejected from the hydraulic pump 1, based on detection of a decrease in an actual engine rotation number. The storage unit 51 provided to the controller 50 in the revolving excavator work machine 10, separately from the storage unit 61 of the external controller 60, stores therein a control output value map M1 of the first control output value C1 corresponding to the target engine rotation number N. In the calculation unit 52 of the controller 50, the first control output value C1 corresponding to the target engine rotation number N is determined based on the control output value map M1. A second control output value C2 for controlling the flow rate of the oil ejected from the hydraulic pump 1 based on detection of a decrease in the actual engine rotation number is calculated. The first control output value C1 and the second control output value C2 are combined to calculate a third control output value C3 corresponding to the control output value C, and the third control output value C3 is corrected with the correction rate R which is the correction coefficient calculated by the calculation unit 62 of the external controller 60.

Further, when the load-sensing type pump control system 5 is configured to perform pump control based on detection of a decrease in the actual engine rotation number, the controller 50 calculates the third control output value C3 by combining the first control output value C1 for changing the target differential pressure ΔP and the second control output value C2 for performing pump control based on the decrease in the actual engine rotation number. This third control output value C3 is corrected with the correction rate R calculated in the external controller 60. This configuration can reduce variation in the effect of the pump control that changes the target differential pressure ΔP as is described above. Additionally, the configuration can reduce variation in the effect of the pump control performed when the actual engine rotation number is lowered.

INDUSTRIAL APPLICABILITY

An embodiment of the present invention is applicable as a control device not only for the revolving excavator work machine described above but also for any hydraulic machine that adopts a load-sensing type hydraulic pump control system.

The invention claimed is:

1. A control device for a hydraulic machine comprising a plurality of hydraulic actuators that are driven by oil ejected from a variable displacement type hydraulic pump driven by an engine, wherein:

the control device is configured to control a flow rate of the oil ejected from the hydraulic pump to achieve a target value of a differential pressure between an ejection pressure of the oil ejected from the hydraulic pump and a load pressure of oil supplied to the hydraulic actuators;

a control pressure for changing the target value of the differential pressure is generated as a secondary pressure of an electromagnetic proportional valve;

the control device comprises a first calculation unit and a target engine rotation number detection unit both provided in the hydraulic machine, and a storage unit, a second calculation unit, and a measured value detection unit which are provided outside of the hydraulic machine, the measured value detection unit configured to detect an actual supply oil flow rate or its substitute numerical value for at least one of the hydraulic actuators;

the first calculation unit is configured to calculate a control output value to become a basis for a current value to be applied to the electromagnetic proportional valve, according to an engine rotation number detected by the target engine rotation number detection unit;

the storage unit is configured to store, for the at least one of the hydraulic actuators, a designed supply oil flow rate value or its substitute numerical value in a specific drive state for the at least one of the hydraulic actuators, the specific drive state being a state assumed when the at least one of the hydraulic actuators is driven with a specific engine rotation number and a specific manual operation amount;

the second calculation unit is configured to calculate a correction coefficient for the control output value, by comparing the actual supply oil flow rate or its substitute numerical value detected by the measured value detection unit when the at least one of the hydraulic actuators is actually driven in the specific drive state, with the designed supply oil flow rate value or its substitute numerical value stored in the storage unit; and the control output value calculated by the first calculation unit is corrected with the correction coefficient calculated by the second calculation unit.

2. The control device according to claim 1, wherein:

the specific manual operation amount in the specific drive state is a maximum manual operation amount of the at least one of the hydraulic actuators, and the specific engine rotation number is an engine rotation number that yields a maximum control output value or its nearby value.

3. The control device according to claim 1, wherein:

the specific manual operation amount in the specific drive state is a minimum manual operation amount of the at least one of the hydraulic actuators, and the specific engine rotation number is an engine rotation number that yields a minimum control output value or its nearby value.

4. The control device according to claim 1, wherein:

the specific drive state includes a first specific drive state and a second specific drive state;

the specific manual operation amount in the first specific drive state and the second specific drive state is a maximum manual operation amount of the at least one of the hydraulic actuators;

the specific engine rotation number in the first specific chive state is an engine rotation number that yields a maximum control output value or its nearby value;

the specific engine rotation number in the second specific drive state is an engine rotation number that yields a minimum control output value or its nearby value; and the second calculation unit calculates a correction coefficient for the control output value, by comparing the actual supply oil flow rate or its substitute numerical value detected by the measured value detection unit when the at least one of the hydraulic actuators is actually driven in each of the first specific drive state and the second specific drive state, with the designed supply oil flow rate value or its substitute numerical value stored in the storage unit.

5. The control device according to claim 1, wherein:

the control device is configured to control the flow rate of the oil ejected from the hydraulic pump, based on detection of a decrease in an actual engine rotation number;

the control device is configured to store a map of first control output values corresponding to the target engine rotation number in another storage unit provided in the hydraulic machine, apart from the storage unit provided outside of the hydraulic machine; and in the first calculation unit, a first control output value corresponding to the target engine rotation number detected by the target engine rotation number detection unit is determined based on the map, a second control output value for controlling the flow rate of the oil ejected from the hydraulic pump based on detection of a decrease in the actual engine rotation number is calculated, the first control output value and the second control output value are combined to calculate a third control output value corresponding to the control output value, and the third control output value is corrected with the correction coefficient calculated by the second calculation unit.

* * * * *